US009239053B2

(12) United States Patent
Shiibayashi et al.

(10) Patent No.: US 9,239,053 B2
(45) Date of Patent: Jan. 19, 2016

(54) HERMETICALLY SEALED SCROLL COMPRESSOR

(75) Inventors: Masao Shiibayashi, Shizuoka (JP); Kenji Tojo, Moriya (JP); Yasushi Izunaga, Shizuoka (JP)

(73) Assignee: HITACHI APPLIANCES, INC., Tokyo (JP)

( * ) Notice: Subject to any disclaimer, the term of this patent is extended or adjusted under 35 U.S.C. 154(b) by 1472 days.

(21) Appl. No.: 12/622,483

(22) Filed: Nov. 20, 2009

(65) Prior Publication Data

US 2010/0129240 A1 May 27, 2010

(30) Foreign Application Priority Data

Nov. 21, 2008 (JP) ..... 2008-297769

(51) Int. Cl.

| | |
|---|---|
| ***F04C 23/00*** | (2006.01) |
| ***F04C 15/06*** | (2006.01) |
| ***F04C 29/00*** | (2006.01) |
| ***F04C 29/02*** | (2006.01) |
| *F04C 18/02* | (2006.01) |
| *F04C 29/04* | (2006.01) |

(52) U.S. Cl.

CPC ..... *F04C 23/008* (2013.01); *F04C 15/06* (2013.01); *F04C 18/0215* (2013.01); *F04C 18/0246* (2013.01); *F04C 29/0007* (2013.01); *F04C 29/028* (2013.01); *F04C 18/0261* (2013.01); *F04C 29/042* (2013.01); *F04C 2210/10* (2013.01); *F04C 2210/105* (2013.01); *F04C 2250/101* (2013.01)

(58) Field of Classification Search

USPC ..... 417/366, 410.5; 418/55.6, 97, 15, 418/55.1–55.5; 62/468, 470, 505, 512, 84

See application file for complete search history.

(56) References Cited

U.S. PATENT DOCUMENTS

| | | | | |
|---|---|---|---|---|
| 4,676,075 | A | 6/1987 | Shiibayashi | |
| 6,478,557 | B2 * | 11/2002 | Shiibayashi et al. | 418/55.2 |
| 6,991,744 | B2 * | 1/2006 | Mahler et al. | 252/68 |
| 2005/0147514 | A1 * | 7/2005 | Lifson et al. | 417/440 |

FOREIGN PATENT DOCUMENTS

| | | | | |
|---|---|---|---|---|
| JP | 03294683 | A * | 12/1991 | F04C 18/02 |
| JP | 2004-232481 | | 8/2004 | |
| JP | 2006-329067 | | 12/2006 | |

* cited by examiner

*Primary Examiner* — Devon Kramer
*Assistant Examiner* — Thomas Fink
(74) *Attorney, Agent, or Firm* — Baker Botts L.L.P.

(57) ABSTRACT

In the hermetically sealed scroll compressor, an injection pipe for injecting a fluid to a compression chamber is connected to an injecting port of a fixed scroll. The injecting port includes a first injecting port which is provided in the vicinity of a fixed scroll inner curve and injects the fluid to an orbiting outer compression chamber, and a second injecting port 22*b* which is provided in the vicinity of a fixed scroll outer curve and injects the fluid to a orbiting inner compression chamber 8*b*. The second injecting port is placed in parallel in a radius direction with respect to the first injecting port and is placed so that an orbiting scroll wrap does not practically communicate with the orbiting outer compression chamber in the state in which the orbiting scroll wrap is in contact with the outer side of a fixed scroll wrap.

17 Claims, 19 Drawing Sheets

HERMETICALLY SEALED SCROLL COMPRESSOR

BACKGROUND OF THE INVENTION

The present invention relates to a hermetically sealed scroll compressor, and is particularly preferable for a hermetically sealed scroll compressor for refrigeration/air conditioning and for helium.

As a conventional scroll compressor, there is the scroll compressor for compressing a gas such as air and a refrigerant, which is disclosed in JP-Y2-1-17669.

The scroll compressor of JP-Y2-1-17669 is constituted of a cylindrical casing, a fixed scroll which is provided by being fixed to the casing to close the end surface of the casing and has a spiral wrap vertically provided on a mirror plate, and a orbiting scroll which is located in the casing and provided turnably at a drive shaft, and has a spiral wrap, which forms a plurality of compression chambers while orbiting by overlapping the wrap of the fixed scroll, vertically provided on the mirror plate. Two oil injection ports are provided in the mirror plate of the fixed scroll to be separated in the radius direction, and the space in the radius direction of the respective oil injection ports is set to be equal to or a little larger than the tooth thickness of a wrap portion of the orbiting scroll. Each of the oil injection ports communicates with one oil supply port. Further, the oil injection port at the center portion side is placed to communicate with the orbiting outer compression chamber in the state in which the wrap of the orbiting scroll is in contact with the outer side of the wrap of the fixed scroll.

Further, as the conventional hermetically sealed scroll compressor, there is cited the hermetically sealed scroll compressor for helium which is disclosed in JP-A-2004-232481.

In the hermetically sealed scroll compressor, a compressor section and a motor section for driving the compressor section are housed and disposed in a hermetically sealed container. The compressor section is constituted by meshing a fixed scroll with a spiral wrap vertically provided on a disk-shaped mirror plate and a orbiting scroll with a spiral wrap vertically provided on a disk-shaped mirror plate with each other with these wraps located on inner sides, engaging the orbiting scroll with an eccentric portion of a crankshaft, causing the orbiting scroll to perform orbiting movement with respect to the fixed scroll without rotating on its axis, and providing the fixed scroll with a discharge port opening to the center portion and an intake port opening to an outer peripheral portion, so as to take in a helium gas from the inlet port, compress the helium gas by moving the compression chambers formed by the fixed scroll and the orbiting scroll to the center to decrease the volume to discharge the helium gas from the discharge port. Further, the compressor section includes an oil injecting mechanism section formed by causing the injection pipe for injecting a fluid to the compression chambers during compression to penetrate through the hermetically sealed container and connect to one oil injecting port which is provided on a wrap tooth groove bottom surface of the fixed scroll. The diameter of the oil injection port is set to be larger than the wrap width of the orbiting scroll.

BRIEF SUMMARY OF THE INVENTION

In the scroll compressor of JP-Y2-1-17669 described above, the oil injection port at the center portion side is placed to communicate with the orbiting outer compression chamber in the state in which the wrap of the orbiting scroll is in contact with the outer side of the wrap of the fixed scroll, and therefore, there is the problem that supplying a proper amount of oil to both the orbiting outer compression chamber and the orbiting inner compression chamber is difficult. For example, if a sufficient oil is set to be injected to the orbiting outer compression chamber, the injection amount of oil to the orbiting inner compression chamber is likely to be insufficient. Conversely, if a sufficient oil is set to be injected to the orbiting inner compression chamber, the injection amount of oil to the orbiting outer compression chamber is likely to be excessive.

Further, in the scroll compressor of JP-A-2004-232481 described above, the injection pipe is connected to one injecting port provided on the wrap tooth groove bottom surface of the fixed scroll, and the diameter dimension of the injecting port is made larger than the wrap width dimension of the orbiting scroll. Therefore, internal leakage between the compression chambers at both sides increases via the oil injecting port, and there arises the problem of causing reduction in performance such as reduction in volume efficiency, increase in internal compression power and the like.

Furthermore, according to the compressor of JP-A-2004-232481, at the time of completion of intake of the two symmetrical compression chambers formed in the scroll compressor, that is, the orbiting outer compression chamber and the orbiting inner compression chamber which will be described later, the time at which the volumes become the maximum are set to be the same, and at the time of discharge of the orbiting outer compression chamber and the orbiting inner compression chamber, the discharge start timings are set to be the same.

FIG. 20 shows the relationship of the intake volumes of these two compression chambers and the rotational angle of the crankshaft which turns the orbiting scroll. Here, Vths represents the intake volume of the orbiting outer compression chamber formed by being enclosed by the wrap outer peripheral surface of the orbiting scroll and the wrap inner peripheral surface of the fixed scroll. Vthk represents the intake volume of the orbiting inner compression chamber formed by being enclosed by the wrap inner peripheral surface of the orbiting scroll and the wrap outer peripheral surface of the fixed scroll.

As shown in FIG. 20, the intake completion times of the orbiting outer compression chamber of the intake volume Vths and the orbiting inner compression chamber of the intake volume Vthk are both at the point C, and the rotational angles correspond to each other. More specifically, the volumes Vths and Vthk of the respective compression chambers change as expressed by the dotted line, and the total volumes of the respective compression chambers Vths+Vthk is at the point D which is twice as large as the volumes Vths, and Vthk at the point C, as shown by the solid line. Therefore, intake of a helium gas temporarily stops in the intake line, and due to impact phenomenon following instant stop of the flow of the helium gas and oil, a large pressure fluctuation occurs. Further, by the reciprocating movement of the displacer portion at the time of the expansion stroke at the refrigerator side, a fluctuation of intake pressure may be promoted.

As above, if a large fluctuation occurs to intake pressure, a large fluctuation occurs to compression torque in the constitution in which an intake gas directly flows in the compressor section, and occurrence of abnormal vibration in an Oldham mechanism portion and the like and decrease in useful life of the compressor are caused. Therefore, an adverse effect is likely to be given to reliability. In order to solve the problem, a surge tank or the like including the function of reducing/suppressing the fluctuation of the intake pressure is conventionally installed in the intake piping line which connects the refrigerant outlet side of a refrigerator and the inlet side of a compressor. However, the volume and the weight of the entire unit as a refrigerating system become large by including such equipment, which is disadvantageous in the aspect of manufacture cost.

In the refrigerating system using the hermetically sealed scroll compressor of JP-A-2004-232481, a high pressure gas discharged from the compressor is guided to a gas cooler, where oil is separated, and the separated oil is guided to the intake piping line, and is supplied to the compressor with a helium gas. In such a case, the oil which is returned to the compressor easily accumulates in the intake chamber of the compression section, the oil causes agitation loss in the orbiting movement of the outer peripheral portion of the orbiting scroll wrap, and causes the problem of reducing the performance of the compressor.

Further, FIG. 21 shows the relationship of the internal pressures of the orbiting outer compression chamber and the orbiting inner compression chamber, and the rotational angle of the crankshaft. Here, Pis represents the internal pressure of the orbiting outer compression chamber, and Pik represents the internal pressure of the orbiting inner compression chamber.

As shown in FIG. 21, the internal pressure Pis of the orbiting outer compression chamber changes as shown by the dashed line, and the internal pressure Pik of the orbiting inner compression chamber changes as shown by the solid line. The discharge start timings of the orbiting outer compression chamber and the orbiting inner compression chamber are both at a point J, and the rotational angles correspond to each other. Thereby, there arise the problems of increase in pressure loss due to narrowing of the discharge passage and flow of a large amount of oil at the time of start of discharge, increase in discharge pressure pulsation, and significant increase in flow resistance loss power.

An object of the present invention is to obtain a hermetically sealed scroll compressor which can supply suitable amounts of oil to an orbiting outer compression chamber and a orbiting inner compression chamber respectively, and can suppress reduction in volume efficiency and increase in inner compression power by reducing internal leakage between the orbiting outer compression chamber and the orbiting inner compression chamber.

Another object of the present invention is to obtain a hermetically sealed scroll compressor which can supply suitable amounts of oil to a orbiting outer compression chamber and a orbiting inner compression chamber respectively, can suppress reduction in volume efficiency and increase in inner compression power by reducing internal leakage between the orbiting outer compression chamber and the orbiting inner compression chamber, further can realize suppression of pressure pulsation of an intake piping line and reduction in oil agitation loss in an intake chamber, and can realize reduction in pressure loss in a discharge passage, suppression of discharge pressure pulsation, and reduction in flow resistance loss power.

According to the invention, a hermetically sealed scroll compressor for compressing a gas, comprises, a compression mechanism including a fixed scroll having a disk shaped mirror plate, a spiral wrap projecting from the disk shaped mirror plate, an intake port for taking the gas into the compression mechanism, and a discharge port for discharging the compressed gas from the compression mechanism, and an orbital scroll which is capable of orbiting with respect to the fixed scroll while being prevented from rotating on an axis of the orbital scroll and which has another disk shaped mirror plate and another spiral wrap projecting from the another disk shaped mirror plate to engage with the spiral wrap so that a first compression chamber is formed between a radially outer side surface of the another spiral wrap and a radially inner side surface of the spiral wrap, a second compression chamber is formed between a radially inner side surface of the another spiral wrap and a radially outer side surface of the spiral wrap, and each of the first and second compression chambers moves radially inward to decrease in its volume to compress therein the gas taken from the intake port to be discharged from the discharge port, an electric motor for driving the compression mechanism so that the orbital scroll orbits with respect to the fixed scroll, a hermetically sealed container containing therein the compression mechanism and the electric motor, and an injection mechanism including an injection port opening on the disk shaped mirror plate to supply a fluid into the gas in the first and second compression chambers, wherein the injection port has first and second injection port portions juxtaposed to each other so that the another spiral wrap is movable between the first and second injection port portions while the spiral wrap is prevented from extending between the first and second injection port portions.

One of the first and second injection port portions may be arranged to be capable of opening to one of the first and second compression chambers, and to be prevented from opening to each of the first and second compression chambers, or each one of the first and second injection port portions may be arranged to be capable of opening to respective one of the first and second compression chambers, and to be prevented from opening to each of the first and second compression chambers.

The first and second injection port portions may be arranged to prevent, during the whole of each orbital rotation of the orbital scroll, one of the first and second compression chambers from simultaneously communicating fluidly with both of the first and second injection port portions, or each one of the first and second compression chambers from simultaneously communicating fluidly with both of the first and second injection port portions.

One of the first and second injection port portions may be arranged to be capable of opening to one of the first and second compression chambers, and to be prevented during the whole of each orbital rotation of the orbital scroll from opening to the other one of the first and second compression chambers, or each one of the first and second injection port portions may be arranged to be capable of opening to respective one of the first and second compression chambers, and to be prevented during the whole of each orbital rotation of the orbital scroll from opening to the other one of the first and second compression chambers other than the respective one thereof.

One of the first and second injection port portions may be arranged to allow the another spiral wrap to move in a direction from the other one of the first and second injection port portions toward the one of the first and second injection port portions until the one of the first and second injection port portions is covered by the another spiral wrap, and to prevent the another spiral wrap from passing over the one of the first and second injection port portions in the direction until the one of the first and second injection port portions is uncovered by the another spiral wrap, or each one of the first and second injection port portions may be arranged to allow the another spiral wrap to move in a direction from the respective other one of the first and second injection port portions toward the each one of the first and second injection port portions until the each one of the first and second injection port portions is covered by the another spiral wrap, and to prevent the another spiral wrap from passing over the each one of the first and second injection port portions in the direction until the each one of the first and second injection port portions is uncovered by the another spiral wrap.

When the first and second injection port portions communicate fluidly with a common fluidal path for supplying the fluid from the common fluidal path to each of the first and second injection port portions, and one of the first and second injection port portions may be arranged at a radially inner side with respect to the other one of the first and second injection port portions, a fluidal flow resistance between the common fluidal path and the one of the first and second injection port portions may be greater than another fluidal flow resistance between the common fluidal path and the other one of the first and second injection port portions, or a minimum inner diameter of the one of the first and second injection port portions is less than another minimum inner diameter of the other one of the first and second injection port portions.

When the radially outer side surface of the another spiral wrap at a radially outer end portion of spiral shape of the another spiral wrap contacts the radially inner side surface of the spiral wrap at a first contact point to make a volume of the first compression chamber maximum, and the radially inner side surface of the another spiral wrap at the radially outer end portion of spiral shape of the another spiral wrap contacts the radially outer side surface of the spiral wrap at a second contact point to make a volume of the second compression chamber maximum, a winding angle of the spiral wrap at the first contact point may be extended angularly by a predetermined angle with respect to a winding angle of the spiral wrap at the second contact point, while each of a winding angle of the another spiral wrap at the first contact point and a winding angle of the another spiral wrap at the second contact point is angularly identical to the winding angle of the spiral wrap at the first contact point. The winding angle of the spiral wrap at the first contact point may be extended angularly by $\pi$rad with respect to the winding angle of the spiral wrap at the second contact point. A compression ratio of the first compression chamber and a compression ratio of the second compression chamber may be substantially equal to each other.

An arc radius of a radially inner terminating end of the another spiral wrap may be greater than an arc radius of a radially inner terminating end of the spiral wrap. In a case of that the arc radius of the radially inner terminating end of the spiral wrap is denoted by Rk1, and the arc radius of the radially inner terminating end of the another spiral wrap is denoted Rs1, Rs1/Rk1=1.4-1.6.

The gas may includes helium, and the fluid may include oil. The gas may include chlorofluorocarbon refrigerant, and the fluid may include at least one of a gaseous matter, a liquid matter and a refrigerant of wet state.

According to the above hermetically sealed scroll compressor of the first mode of the present invention, suitable amounts of oil can be respectively supplied to the orbiting outer compression chamber and the orbiting inner compression chamber, and the internal leakage between the orbiting outer compression chamber and the orbiting inner compression chamber is reduced so that reduction in the volumetric efficiency and increase in the internal compression power can be suppressed.

Further, according to the above hermetically sealed scroll compressor of the second mode of the present invention, suitable amounts of oil can be respectively supplied to the orbiting outer compression chamber and the orbiting inner compression chamber, the internal leakage between the orbiting outer compression chamber and the orbiting inner compression chamber is reduced so that reduction in volumetric efficiency and increase in the internal compression power can be suppressed, in addition to which, suppression of the pressure pulsation of the intake piping line and reduction in oil agitation loss in the intake chamber are realized, and reduction in the pressure loss in the discharge passage, suppression of the discharge pressure pulsation and reduction in the flow resistance loss power can be realized.

Other objects, features and advantages of the invention will become apparent from the following description of the embodiments of the invention taken in conjunction with the accompanying drawings.

DETAILED DESCRIPTION OF THE INVENTION

Figure 1:
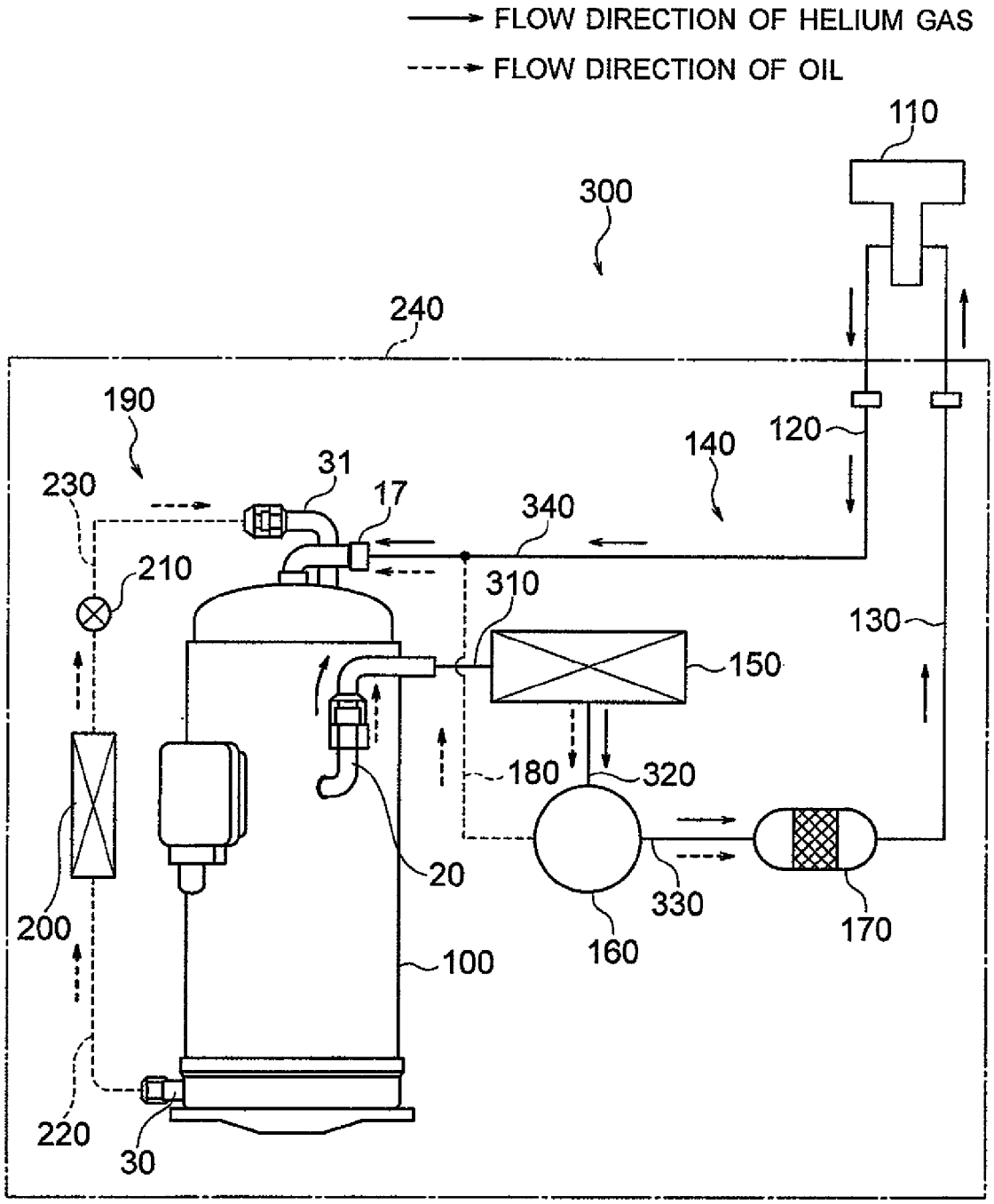
FIG. 1 is a general block diagram of a refrigerating apparatus including a hermetically sealed scroll compressor for helium of a first embodiment of the present invention.

Hereinafter, a plurality of embodiments of the present invention will be described with use of the drawings. The same reference numerals and characters in the drawings of the respective embodiments show the same things or corresponding things.

First Embodiment

A first embodiment of the present invention will be described by using FIGS. 1 to 16.

Figure 2:
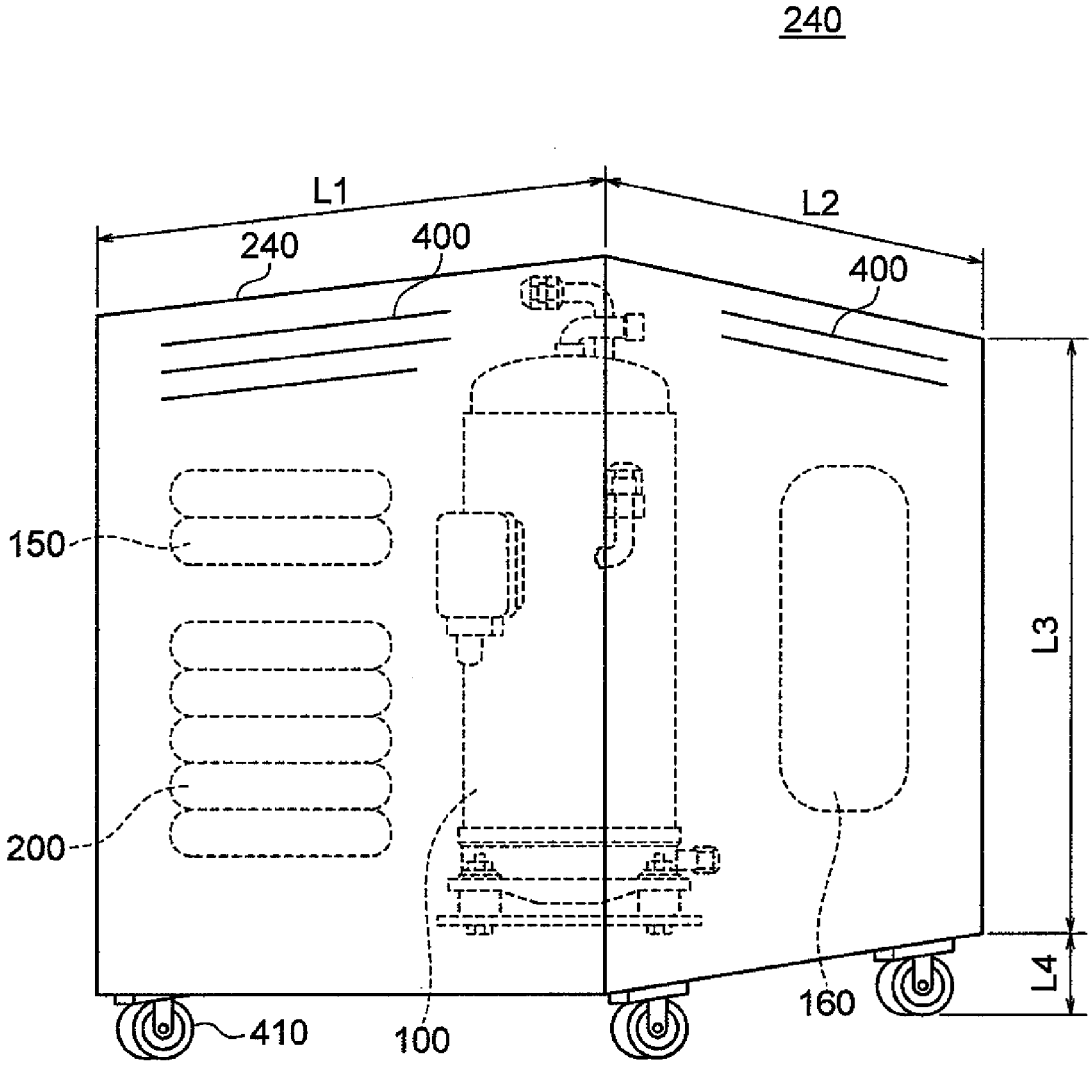
FIG. 2 is a perspective view showing an appearance of a compressor unit of FIG. 1.
Figure 3:
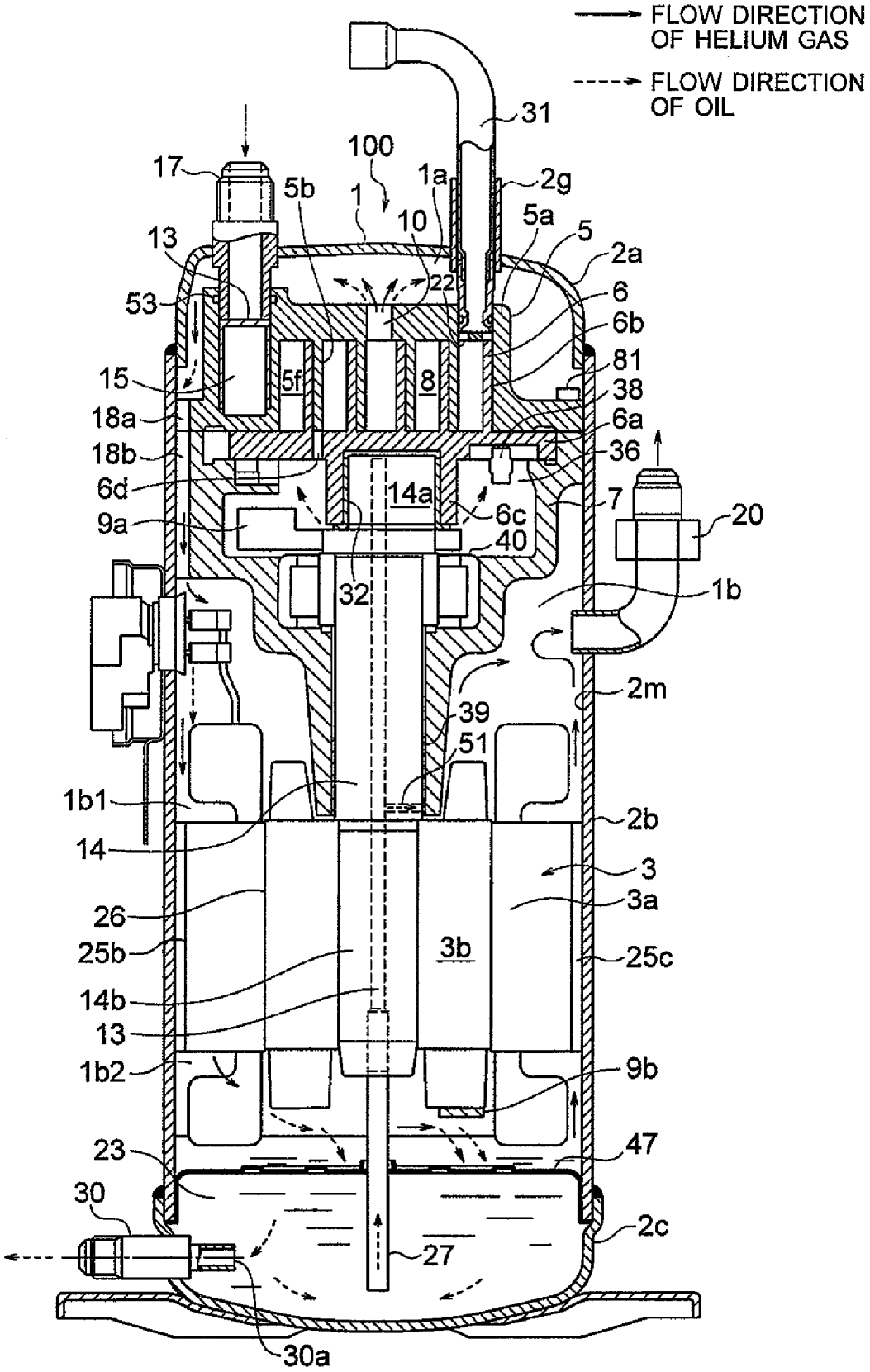
FIG. 3 is a vertical sectional view showing an entire constitution of the compressor of FIG. 1.

FIG. 1 is a general block diagram of a refrigerating apparatus including a hermetically sealed scroll compressor for helium of the present embodiment. FIG. 2 is a perspective view showing an appearance of a compressor unit of FIG. 1. FIG. 3 is a vertical sectional view of the hermetically sealed scroll compressor for helium of FIG. 1.

In FIG. 1, a refrigerating apparatus 300 is constituted by including a vertical type hermetically sealed scroll compressor 100 for helium (hereinafter, properly abbreviated as a compressor 100), and a refrigerator 110. The compressor 100 and the refrigerator 110 constitute a refrigeration cycle 140 which circulates an operating refrigerant by being connected through pipings 120 and 130. In the refrigeration cycle 140, a gas cooler 150, an oil separator 160, and an oil absorber 170 are placed. Further, a piping 180 for returning oil to the compressor 100 from the oil separator 160 by bypassing the oil absorber 170 and the refrigerator 110 is provided. As an operating refrigerant of such a refrigeration cycle 140, a helium gas is used.

Meanwhile, the compressor 100 is provided with an oil injection circuit 190 which extracts a lubricating oil in the compressor 100 to outside and cools the lubricating oil, and returns the lubricating oil to the compressor 100 again to circulate the lubricating oil. The oil injection circuit 190 is constituted by including an oil cooler 200 and an oil flow rate regulating valve 210, and connecting them by pipings 220 and 230. The oil injection circuit 190 is connected to between an oil extracting pipe 30 which communicates with a lubricating oil 23 accumulating in a bottom portion in the compressor 100 and an oil injection pipe 31 which communicates with a compression chamber 8 of the compressor 100.

The aforementioned devices which constitute the refrigerating apparatus 300 are housed in a compressor unit 240 shown by a dashed line of FIG. 1. These devices are housed to be arranged as shown in FIG. 1 in the compressor unit 240. The solid line arrows in FIGS. 1, 3, 8, 9 and 10 show the flow direction of a helium gas, and the dotted line arrows show the flow direction of oil.

The lubricating oil 23 which are accumulated in the bottom portion of a hermetically sealed container 1 is taken outside from the oil extracting pipe 30 by the discharge pressure in an internal space of the hermetically sealed container 1, guided to the oil cooler 200 through the piping 220, and after cooled by external air here, the lubricating oil 23 flows in an oil piping route which extends through the oil flow rate regulating valve 210 and the piping 230 to the oil injection pipe 31. The oil in the oil injection pipe 31 is injected into the compression chamber 8 of the compressor 100 through an oil injecting port 22 (see FIG. 3), and thereby, is returned into the compressor 100.

Meanwhile, the helium gas which is discharged from the compressor 100 through a discharge pipe 20 flows through a piping 310 into the gas cooler 150, where the helium gas is cooled, and thereafter, the helium gas is guided to the oil separator 160 through a piping 320. The helium gas, from which oil is separated to a certain degree here, flows into the oil absorber 170 through a piping 330, and further has the residual oil separated, after which, the helium gas is guided into the refrigerator 110 through the piping 130. The helium gas which is guided into the refrigerator 110 becomes a cold heat source by being subjected to adiabatic expansion inside the refrigerator. The helium gas which is discharged from the refrigerator 110 passes through the piping 120 and an intake piping 340, and is directly returned to the compressor 100 as an intake gas at a room temperature. Here, the piping 180 is connected to the intake piping 340 so that the oil separated in the oil separator 160 is returned.

The refrigerating apparatus 300 absorbs large pressure pulsation which occurs at the compressor side and the refrigerator side with an intake piping system therebetween, and can significantly reduce the pressure pulsation. Further, the refrigerating apparatus 300 does not need a surge tank which is conventionally installed on, for example, the intake piping 340, and can directly connect the refrigerator 110 and the compressor 100 with the pipings.

In FIG. 2, the compressor unit 240 is formed by a casing substantially in a rectangular parallelepiped shape having the outside dimensions of a lateral width L1, a depth L2 and a height L3, and is provided with a caster 410 at a bottom portion of the casing to be movable. Further, for ventilation of a cooling fan internally provided, vent holes (louver portions) 400 are provided on a front surface, a side surface and the like. As for the outside dimensions of the compressor unit 240, three dimensions can be reduced since installation of a surge tank is not needed. L4 denotes a height dimension of the caster portion.

Next, with reference mainly to FIG. 3, the general constitution of the compressor 100 will be described. The compressor 100 houses a compressor section 4 and a motor section 3 as an electric motor by vertically arranging them in a vertically long hermetically sealed container 1. The hermetically sealed container 1 is constituted by combining an upper lid 2*a*, a cylindrical barrel section 2*b* and a bottom section 2*c*. The compressor section 4 forms the compression chamber 8 to be a hermetically sealed space by meshing a fixed scroll 5 and a orbiting scroll 6 with each other.

The fixed scroll 5 is constituted of a disk-shaped mirror plate 5*a*, and a wrap 5*b* which is formed into an involute curve or a curve analogous to this which stands upright on the mirror plate 5*a*, and includes a discharge port 10 in its center portion and an intake port 15 at an outer peripheral portion. The intake port 15 is constituted of a first intake port 15*a* communicating with an intake pipe 17, and a second intake port 15*b* communicating with the intake port 15*a* (see FIGS. 4 and 5). An O-ring 53 which seals a high pressure part and a low pressure part is provided between the intake pipe 17 and the fixed scroll 5.

The orbiting scroll 6 is constituted of a disk-shaped mirror plate 6*a*, a wrap 6*b* which is formed into the same shape as the wrap 5*b* of the fixed scroll to stand upright on the mirror plate 6*a*, and a boss portion 6*c* formed on an counter-wrap surface of the mirror plate 6*a*. A main bearing 40 is formed in a central portion of a frame 7, and a crankshaft 14 is supported on the main bearing 40. An eccentric shaft 14*a* at a tip end of the crankshaft is inserted in the boss portion 6*c* to be capable of orbiting movement.

The fixed scroll 5 is fixed to the frame 7 with a plurality of bolts. The orbiting scroll 6 is supported at the frame 7 by an Oldham mechanism 38 constituted of an Oldham ring and an Oldham key, and is formed to perform orbiting movement without rotating on its own axis with respect to the fixed scroll 5. A motor shaft 14*b* is provided to connect integrally to the crankshaft 14, and the motor shaft 14*b* is directly connected to the motor section 3.

The oil injection pipe 31 for supplying oil which cools a helium gas is provided to penetrate through the upper lid 2*a* of the hermetically sealed container 1 to communicate with the oil injecting port 22 provided in the mirror plate portion 5*a* of the fixed scroll 5. The oil injecting port 22 opens to oppose to the orbiting scroll 6. The intake piping 17 for taking a helium gas into the hermetically sealed container 1 penetrates the upper lid 2*a* of the hermetically sealed container 1 to be connected to the intake port 15 of the fixed scroll 5.

In the hermetically sealed container 1, a discharge chamber 1*a* to which the discharge port 10 of the fixed scroll 5 opens, and a motor chamber 1*b* are formed to be vertically partitioned by the frame 7. The discharge chamber 1*a* communicates with the motor chamber 1*b* through first passages 18*a* and 18*b* at the outer edge portions of the fixed scroll 5 and the frame 7, and the motor chamber 1*b* communicates with a discharge pipe 20 which penetrates through the barrel section 2*b* of the hermetically sealed container 1.

The discharge pipe 20 is placed in a position at a side substantially opposite to the positions of the first flow paths 18*a* and 18*b*. The motor chamber 1*b* is partitioned into an upper space 1*b*1 of the stator 3*a* and a lower space 1*b*2 of the stator 3*a*, and passages 25*b* and 25*c* to be flow path portions for oil and a gas are formed between the stator 3*a* and an inner wall surface 2*m* of the barrel section 2*b* so as to communicate with the spaces 1*b*1 and 1*b*2. Further, a gap 25*g* of a motor air gap also becomes a passage, and the upper space 1*b*1 and the lower space 1*b*2 communicate with each other through the gap 25*g*. In order to cancel a centrifugal force which occurs with orbiting movement of the orbiting scroll 6, a balance weight 9*a* and an auxiliary balance weight 9*b* are provided at the crankshaft 14 and a rotor 3*b*.

By flow of the mixture if a gas and oil in the spaces 1*b*1 and 1*b*2 in the container like this, direct cooling for the motor section 3 by injection oil at a relatively low temperature of, for example, 60° C. to 70° C. is enabled. The oil in the gas is separated from the gas in the upper space 1*b*1 and flows down through the second passage 25*b* at a lower side while cooling the surrounding members.

A space 36 (hereinafter, called a middle pressure chamber 36) surrounded by the compressor section 4 and the frame 7 is formed in the rear surface of the mirror plate 6*a* of the orbiting scroll 6. A middle pressure between the intake pressure and discharge pressure is introduced into the middle pressure chamber 36 through a middle pressure hole 6*d* which penetrates through the mirror plate 6*a* of the orbiting scroll 6, and the applied force in the axial direction to press the orbiting scroll 6 against the fixed scroll 5 is given.

The oil separated from the helium gas is accumulated in the bottom portion of the hermetically sealed container 1 as the lubricating oil 23. After the lubricating oil 23 is sucked up to an oil suction pipe 27 by the pressure difference between the high pressure (discharge pressure) in the internal space of the hermetically sealed container 1 and the middle pressure of the middle pressure chamber 36, the lubricating oil 23 rises in a central hole 13 in the crankshaft 14, is supplied to an orbiting bearing 32 from the upper end of the central hole 13, and is supplied to an auxiliary bearing 39 and a main bearing 40 through a lateral hole 51. The lubricating oil 23 which is supplied to the orbiting bearing 32 and the main bearing 40 is injected into the compression chamber 8 formed by a scroll wrap through the middle pressure chamber 36 and the middle pressure hole 6*d*. In the compression chamber 8, the lubricating oil 23 is mixed with the compression gas, and is discharged to the discharge chamber 1*a* with the helium gas. A foaming preventing oil plate 47 is provided on an oil surface of the lubricating oil 23 which is accumulated in the bottom portion of the hermetically sealed container 1 so as to prevent a foaming phenomenon of the lubricating oil 23, which occurs at the time of actuation of the compressor 100.

The oil extracting pipe 30 for extracting the lubricating oil 23 outside the container is provided at the bottom portion of the hermetically sealed container 1. The lubricating oil 23 which is accumulated in the bottom portion of the hermetically sealed container 1 flows into the oil extracting pipe 30 from an inlet portion 30*a* of the oil extracting pipe 30 by the pressure difference between the high pressure (discharge pressure) in the internal space of the hermetically sealed container 1 and the pressure (pressure lower than the discharge pressure) of the compression chamber 8 during compression. After the lubricating oil 23 is properly cooled in the cooler 200, the lubricating oil 23 is injected into the compression chamber 8 through the oil injection pipe 31 and the oil injecting port 22.

The oil which is injected into the compression chamber 8 in this manner performs the operation of cooling the helium gas in the compression chamber 8, and the function of lubricating the sliding portions of the tip end portion of the scroll wrap and the like. Subsequently, the oil is discharged into the discharge chamber 1*a* from the discharge port 10 with the operating gas, and moves to the motor chamber 1*b* at the lower side.

Figure 4:
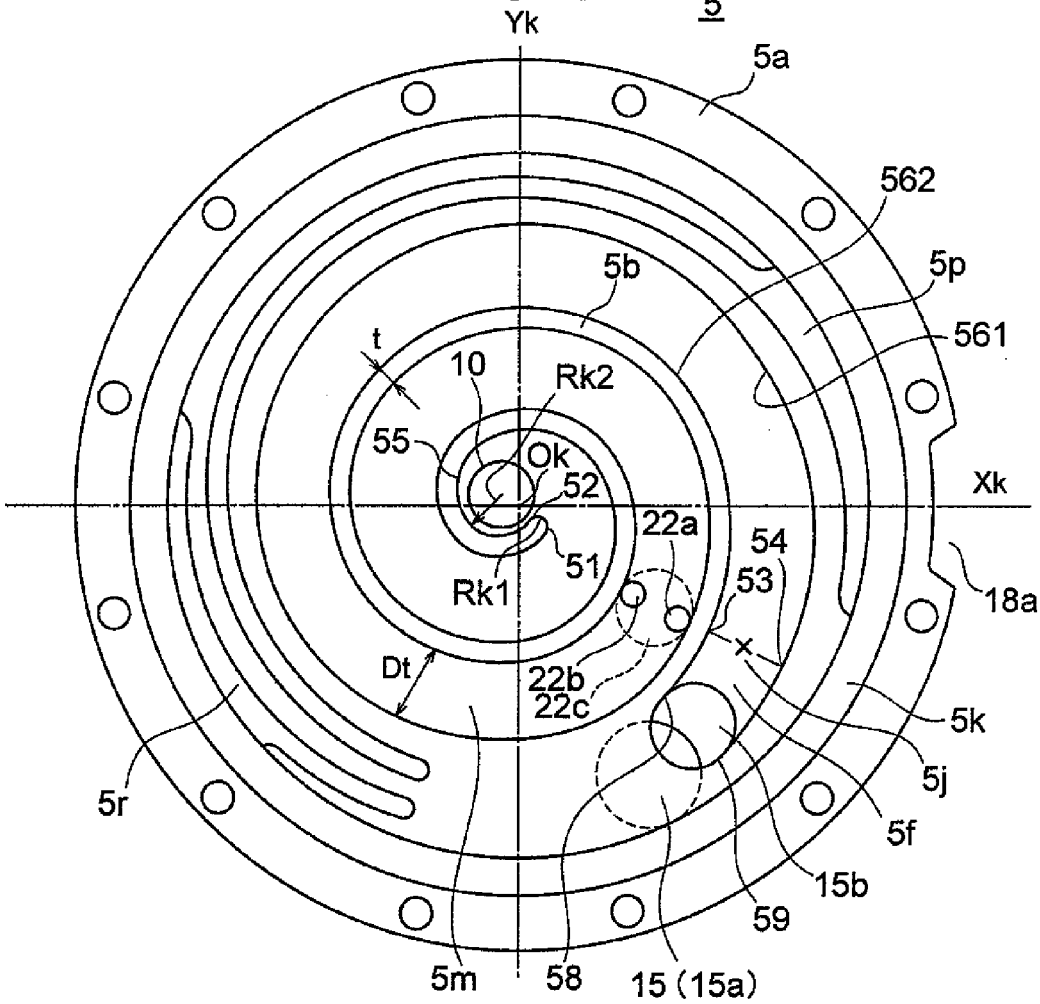
FIG. 4 is a plane view of a fixed scroll of FIG. 3.
Figure 5:
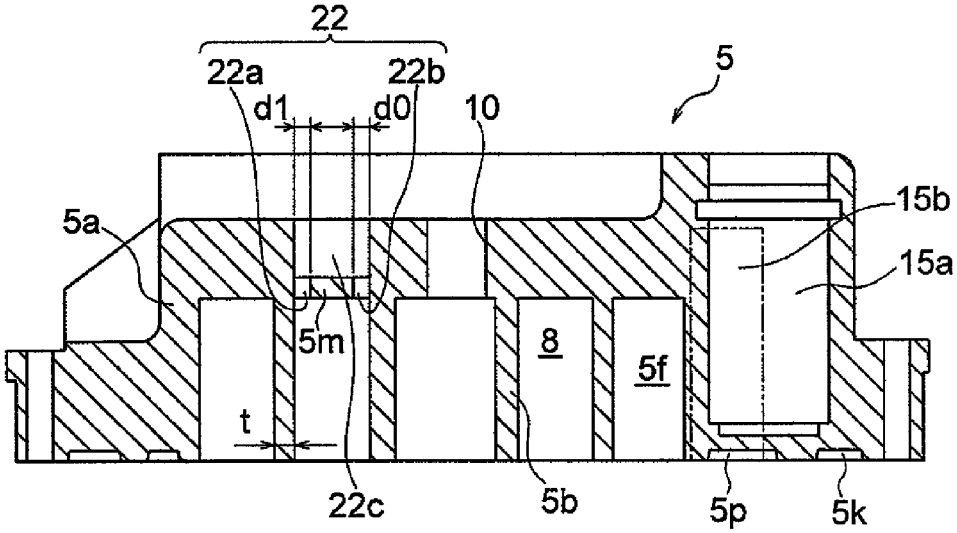
FIG. 5 is a vertical sectional view of the fixed scroll of FIG. 4.

Next, with reference mainly to FIGS. 4 and 5, the constitution of the fixed scroll 5 will be described. FIG. 4 is a plane view of the fixed scroll of FIG. 3. FIG. 5 is a vertical sectional view of the fixed scroll of FIG. 4.

The fixed scroll 5 is constituted of a disk-shaped mirror plate 5*a* and the wrap 5*b* standing upright on the mirror plate 5*a* as described above, and includes the discharge port 10 in its center portion and the inlet port 15 (15*a*, 15*b*) at the outer peripheral portion. The wrap 5*b* forms a wrap outer peripheral surface 562 and a wrap inner peripheral surface 561 of the involute curves respectively to points 58 and 59 at the wrap terminal end portion, and is connected to the intake port 15 in an intake chamber 5*f*. Ok denotes a coordinate center point, and Xk and Yk express coordinate axes.

Points 53 and 54 show the contact point positions at the outermost peripheral portion forming the compression chamber 8. More specifically, the point 53 and the point 54 become the contact point positions when the wrap terminal end portion of the orbiting scroll 6 contacts the wrap outer peripheral surface 562 and the wrap inner peripheral surface 561 respectively to form the compression chamber 8.

A stroke volume Vths at the side of an orbiting outer compression chamber 8*a*, which is formed by a orbiting scroll wrap outer curve 661 and a fixed scroll wrap inner curve 561, increases with respect to a stroke volume Vthk at the side of an orbiting inner compression chamber 8*b* formed by a orbiting scroll wrap inner curve 662 and the fixed scroll wrap inner curve 562. The point 54 to be the contact point position of the outermost peripheral portion forming the orbiting outer compression chamber 8*a*, of the fixed scroll wrap inner curve 561 extends the winding angle by πrad with respect to the prior art. The extended wrap winding angle πrad is the maximum angle, and the amount of (1−⅛)πrad, or (1−⅙)πrad, which is smaller than the maximum angle is included in the scope of the present invention.

The points 51 and 52 at the wrap start end portion (the innermost peripheral portion) are smoothly connected by an arc radius Rk1. Further, a point 55 at the wrap start end portion side, of the inner curve 561 is smoothly connected to the point 52 by the shape of a recessed portion of an arc radius Rk2. 5*k* denotes a ring-shaped oil groove for lubrication which is provided on the surface of the mirror plate 5*a*, and 5*p* and 5*r* denote the arc-shaped oil grooves for lubrication which are provided on the surface of the mirror plate 5*a*.

A tooth groove dimension (Dt dimension of FIG. 4) of the fixed scroll 5 is given by the following expression (1).

$$Dt=2\times\epsilon th\ t \qquad \text{[Expression 1]}$$

Here,

ϵth: orbiting radius t: Wrap thickness

Figure 6:
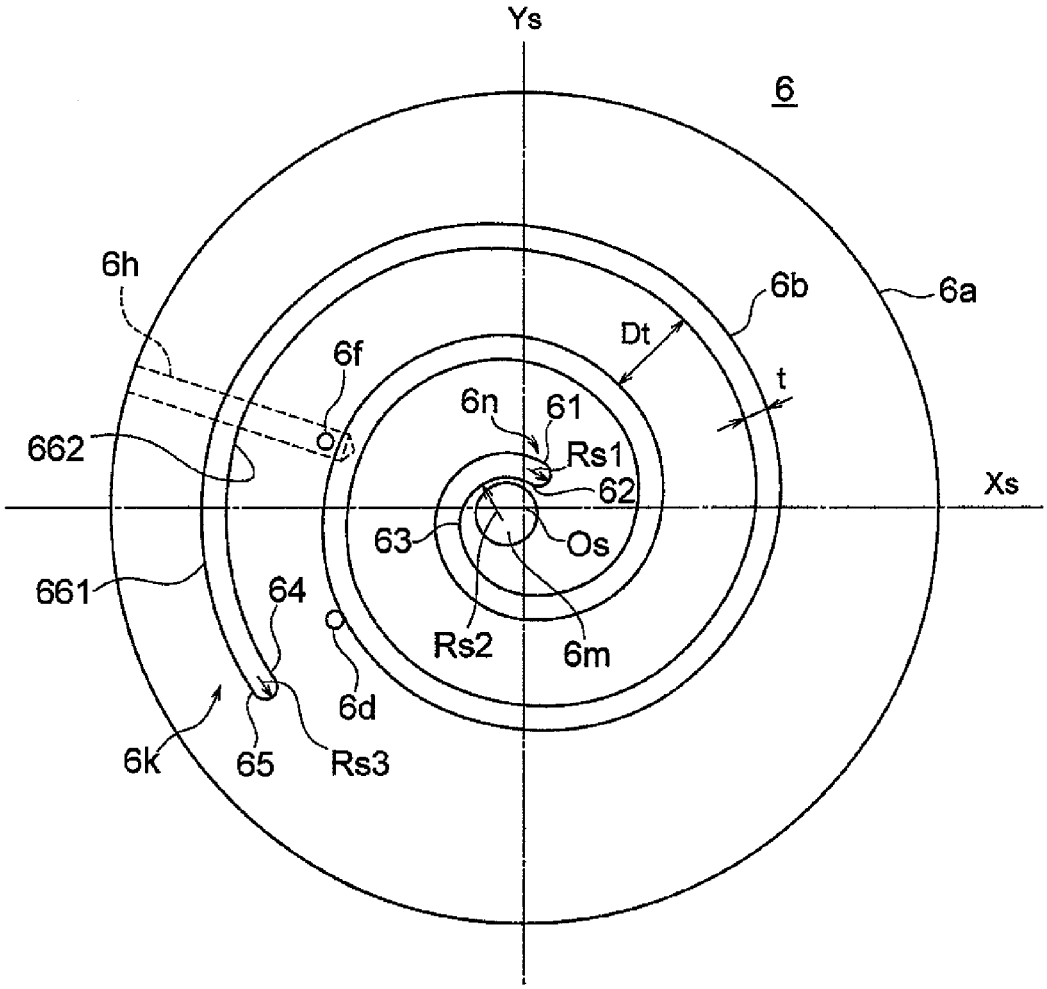
FIG. 6 is a plane view of a orbiting scroll of FIG. 3.
Figure 7:
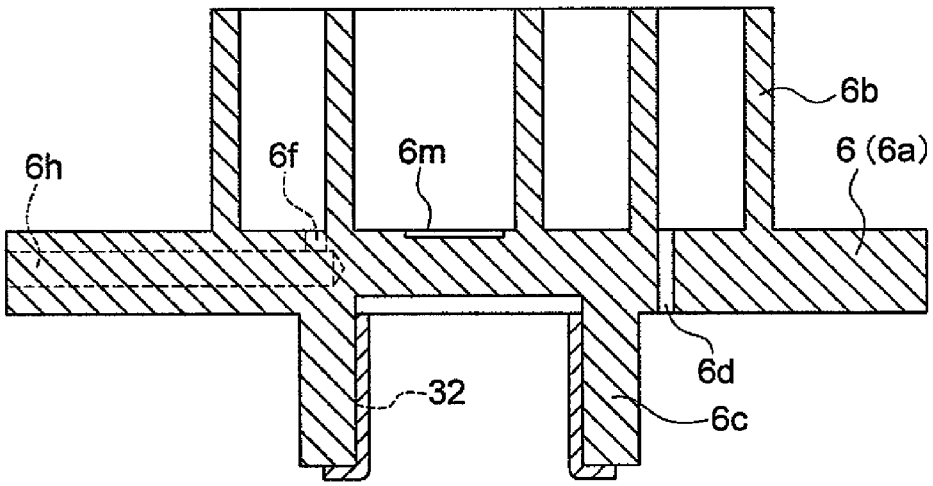
FIG. 7 is a vertical sectional view of the orbiting scroll of FIG. 6.

Next, with reference mainly to FIGS. 6 and 7, the constitution of the orbiting scroll 6 will be described. FIG. 6 is a plane view of the orbiting scroll of FIG. 3. FIG. 7 is a vertical sectional view of the orbiting scroll of FIG. 6.

The orbiting scroll 6 is constituted of the disk-shaped mirror plate 6*a* and the wrap 6*b* standing upright on the mirror plate 6*a* as described above, and forms the wrap inner peripheral surface 662 and the wrap outer peripheral surface 661 of the involute curves respectively to a point 64 and a point 65 of a wrap terminal end portion 6*k*. The point 64 and the point 65 are smoothly connected by an arc radius Rs3. A point 61, a point 62 and a point 63 at a wrap start end portion 6*n* are smoothly connected by a projected portion shape of an arc radius Rs1 and a recessed portion shape of an arc radius Rs2. Os denotes a coordinate center point and Xs and Ys denote coordinate axes.

A groove 6*m* is provided in the position opposed to the discharge hole 10 of the fixed scroll 5, and is formed by a recessed portion of the size equivalent to the discharge hole 10.

In the orbiting scroll 6, the single middle pressure hole 6*d* which penetrates through the mirror plate portion 6*a* in the axial direction, and a single oil discharge mechanism constituted of a radial lateral hole 6*h* provided in the axis central direction in the mirror plate portion 6*a*, and an oil discharge hole 6*f* in the axial direction which communicates with the lateral hole 6*h* and opens in the wrap direction are included, and the middle pressure hole 6*d* and the opening of the oil discharge hole 6*f* are disposed in the positions along the outer curve 661. The middle pressure hole 6*d* is not set at the position along the inner curve 662 of the orbiting scroll 6 since the compression chambers 8*a* and 8*b* are constituted to be shifted by πrad in terms of pressure. This is because if the middle pressure hole 6*d* is set at the position along the inner curve 662, the holes 6*d* and 6*f* are located in the orbiting bearing side direction to be in the position further inward by πrad, and there arises a drawback in machining that the hole machining becomes difficult.

Figure 8:
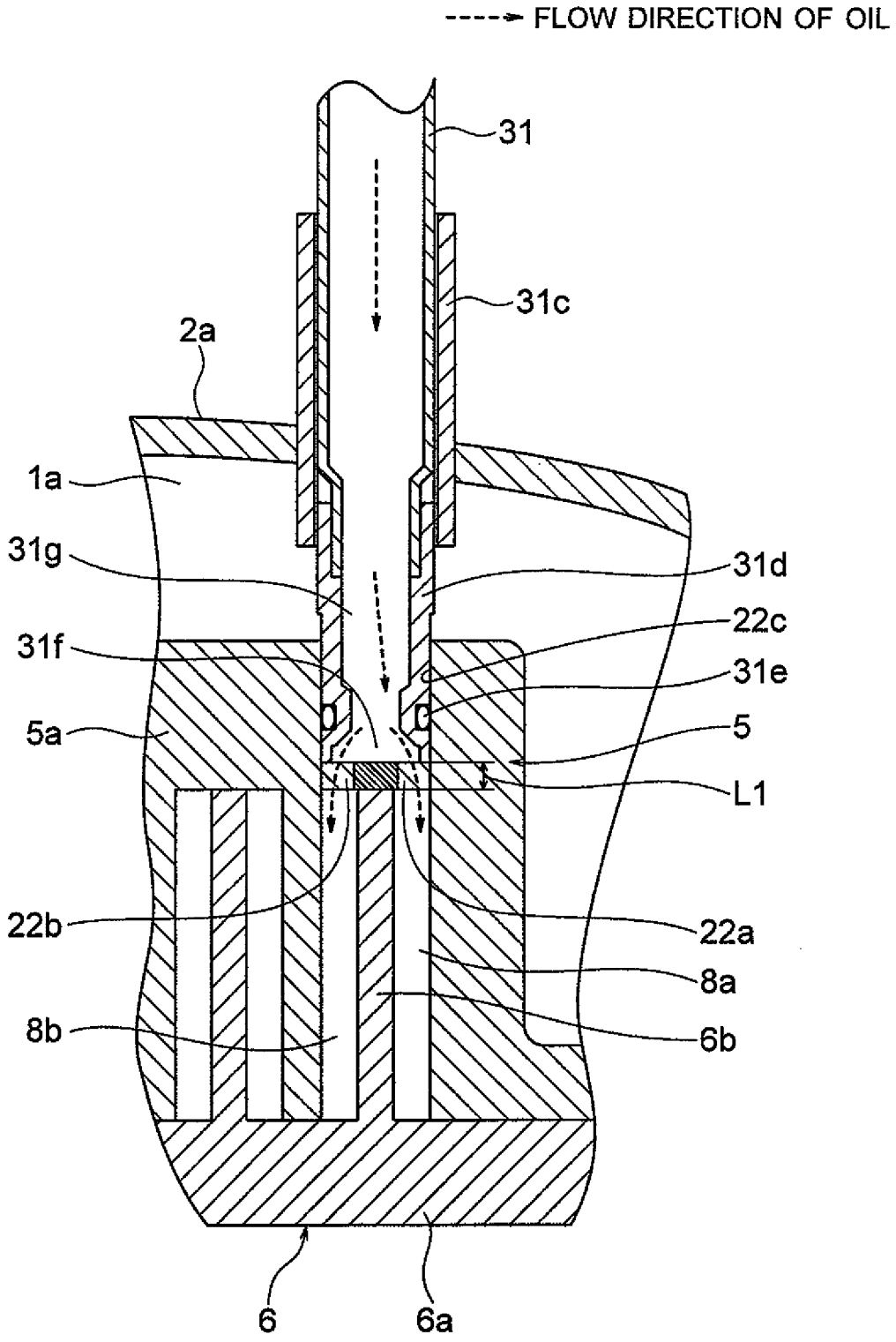
FIG. 8 is an enlarged sectional view of an injecting mechanism section of the compressor of FIG. 1.

Next, with reference mainly to FIGS. 3 to 5 and 8, an oil injecting mechanism section will be described. FIG. 8 is an enlarged view of the oil injecting mechanism section of FIG. 3.

For cooling of the compressor main body, reduction in the temperature/cooling of generated heat at the time of adiabatic compression of a helium gas, lubrication of the sliding portions and the like, the oil injection structure for cooling is included as described above. The oil injecting port 22 using oil as a cooling liquid is provided in the mirror plate portion 5*a*. The oil injecting port 22 is constituted of a first injecting port 22*a* and a second injecting port 22*b*. Thereby, internal leakage between the orbiting outer compression chamber 8*a* and the orbiting inner compression chamber 8*b* is reduced, and reduction in volume efficiency and increase in internal compression power can be suppressed.

The injecting port 22*a* injects oil to the orbiting outer compression chamber 8*a* formed by the orbiting scroll outer curve 661 and the fixed scroll inner curve 561, and is provided in a wrap tooth groove bottom surface 5 *m* in the vicinity of the fixed scroll inner curve 561. The injecting port 22*b* injects oil to the orbiting inner compression chamber 8*b* formed by the orbiting scroll inner curve 662 and the fixed scroll outer curve 562, and is provided in the wrap tooth groove bottom surface 5*m* in the vicinity of the fixed scroll outer curve 562. The oil injecting port 22*b* is arranged in the radius direction with respect to the oil injecting port 22*a*, and is placed at a position which does not practically communicate with the orbiting outer compression chamber 8*a* in the state in which the wrap 6*b* of the orbiting scroll 6 is in contact with the outer side of the wrap 5*b* of the fixed scroll 5 (in the state shown in FIG. 10). By such a constitution, proper amounts of oil can be supplied to the orbiting outer compression chamber 8*a* and the orbiting inner compression chamber 8*b*.

The two injecting ports 22*a* and 22*b* are in the positional relationship opposed to each other, and oil inlet ports of these oil injecting ports 22*a* and 22*b* communicate with each other by a single circular hole portion 22*c* provided in the mirror plate 5*a* of the fixed scroll 5. The circular hole portion 22*c* constitutes a communication portion 31*f*. A single oil injection pipe 31 is inserted in the circular hole portion 22*c*, and a space in a tip end portion of the oil injection pipe 31 constitutes the communication portion 31*f* with the oil inlet ports of the oil injecting ports 22*a* and 22*b*. According to such a constitution, with the two oil injecting ports 22*a* and 22*b*, the oil injection pipe 31 for injecting the cooling oil at the upstream side can be made a single piping, the number of components is reduced by half, cost can be reduced and reliability of the compressor can be increased.

An O-ring 31*e* for sealing the gap between the discharge chamber 1*a* which is a high pressure chamber and the compression chamber 8 is provided between the oil injection pipe 31 and the fixed scroll 5. Further, the hole diameters of the respective oil injecting ports 22*a* and 22*b* are set as D0 and D1, and set to be equivalent to or smaller than a wrap thickness t. The hole diameters D0 and D1 of the two oil injecting ports 22*a* and 22*b* are set to be dimensions differing from each other, so that the two oil injecting ports 22*a* and 22*b* are constituted to have different flow resistances. In concrete, the hole diameter D1 of the oil injecting port 22*b* is set to be smaller than the hole diameter D0 of the oil injecting port 22*a*, so that the flow resistance of the oil injecting port 22*b* is constituted to be larger than the flow resistance of the oil injecting port 22*a*. Further, the flow path length L1 of the two oil injecting ports 22*a* and 22*b* is set to be a proper length. Thereby, internal leakage of the helium gas from the orbiting inner compression chamber 8*b* to the oil injecting port 22*b*, the communication portion 31*f* and the oil injecting port 22*a* can be restricted.

The opening time of the oil injecting port 22*b* to the orbiting outer compression chamber 8*a*, and the opening time of the oil injecting port 22*a* to the orbiting inner compression chamber 8*b* become the oil injection timings differing in phase from each other by about 180 degrees. Thereby, even if the diameters D0 and D1 of the two oil injecting ports 22*a* and 22*b* are set to be smaller than the wrap thickness of the orbiting scroll 6, the two oil injecting ports 22*a* and 22*b* include the oil injecting function which are not closed at the same time by the orbiting scroll 6. Therefore, oil flow in the oil piping becomes smooth, a phenomenon of increase in piping vibration by an oil impact phenomenon, and a phenomenon of increase in piping stress can be avoided, and noise and vibration of the compressor main body can be reduced.

The position of the oil injecting port 22*b* is set at the position which is inward by about 2×πrad in the scroll wrap winding angle with respect to the point 53. Further, the position of the oil injecting port 22*a* is set at the position inward by about 2×πrad in the scroll wrap winding angle with respect to the point 54. By setting them at these positions, the heating action by injection of the injection oil in the orbiting outer compression chamber 8*a* and the orbiting inner compression chamber 8*b* is reduced, in order to perform oil injection action directly after the intake stroke of the helium gas is finished, and the effect of enhancing the volumetric efficiency of the compressor is obtained. The diameter of the circular hole portion 22*c* is equivalent to the tooth groove dimension Dt.

The oil injection pipe 31 is of an elbow structure. The oil injection pipe 31 penetrates through the upper lid 2*a* of the hermetically sealed container 1 to communicate with the oil injecting ports 22*a* and 22*b* provided in the mirror plate portion 5*a* of the fixed scroll 5.

Figure 9:
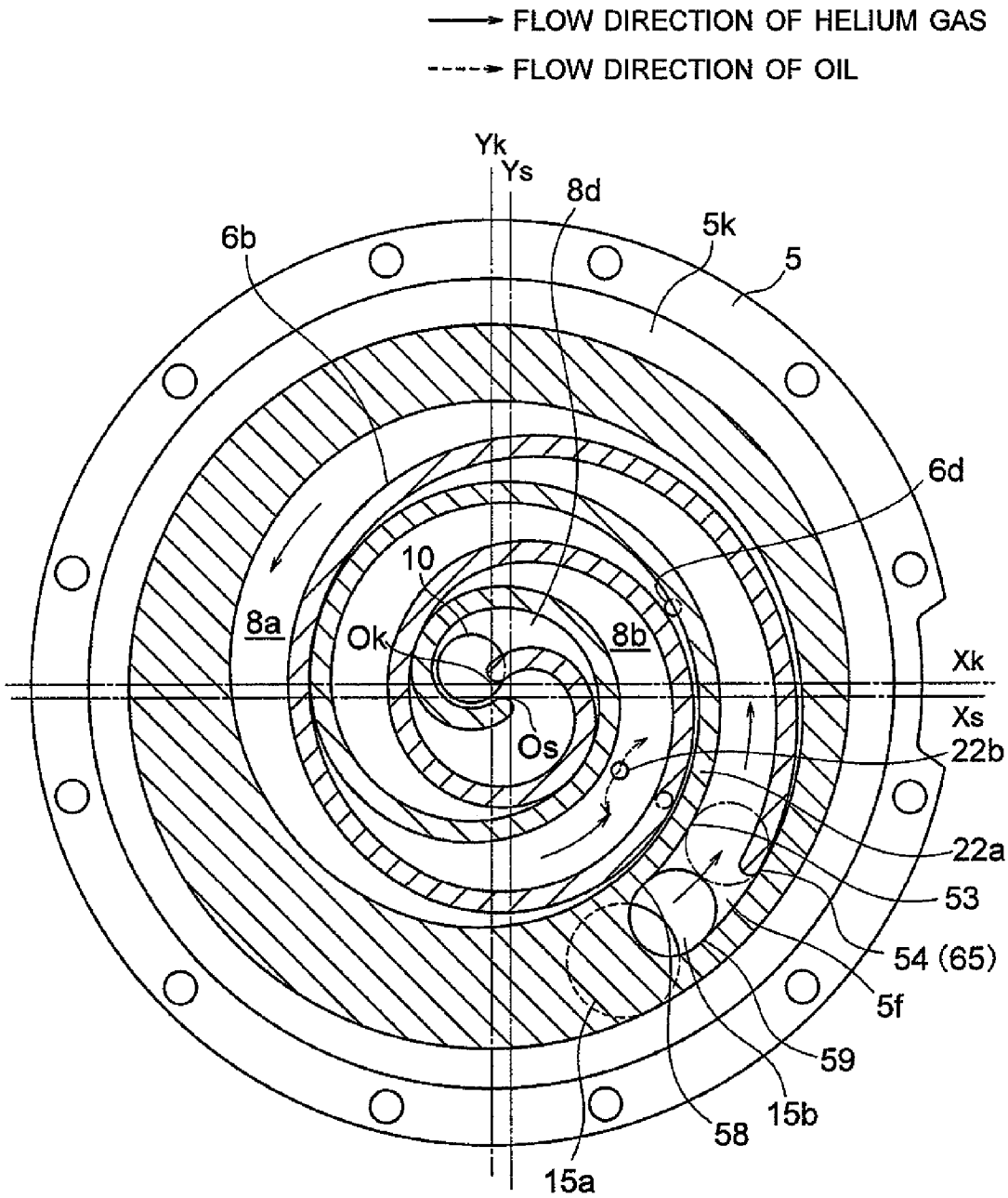
FIG. 9 is a sectional plane view showing the state in which the fixed scroll and the orbiting scroll of FIG. 3 are combined.
Figure 10:
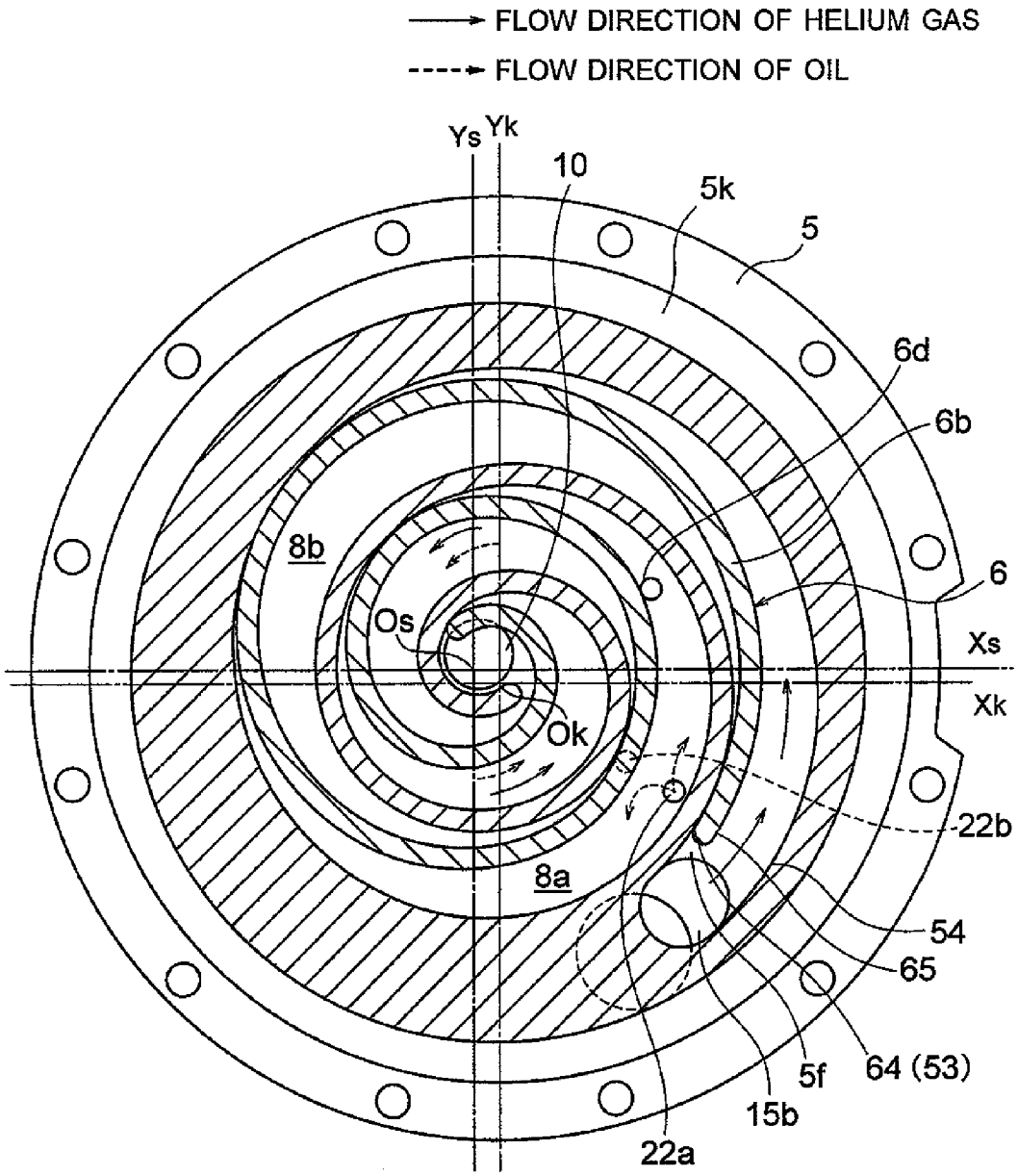
FIG. 10 is a sectional plane view of the time when the orbiting scroll is further turned with respect to FIG. 9.
Figure 11:
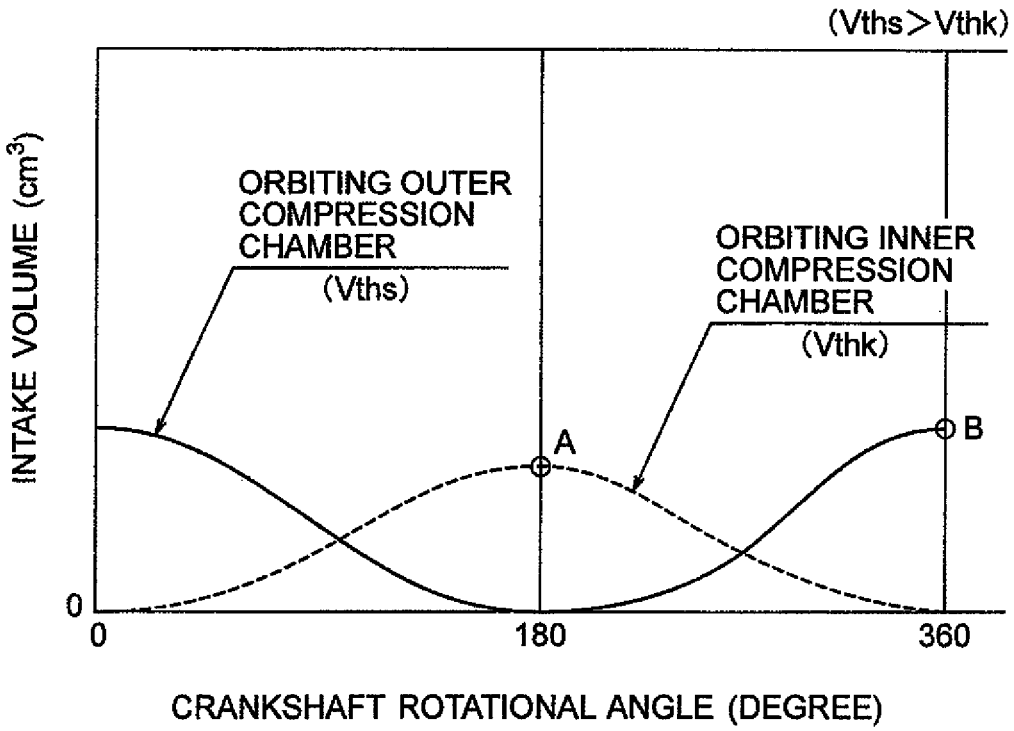
FIG. 11 is a diagram explaining the relationship of intake volumes of an orbiting outer compression chamber and a orbiting inner compression chamber, and a crankshaft rotational angle in the first embodiment.

Next, with reference mainly to FIGS. 9 to 11, the compressor section 4 will be described. FIG. 9 is a sectional plane view showing a state in which the fixed scroll and the orbiting scroll of FIG. 3 are combined. FIG. 10 is a sectional plane view when the orbiting scroll is further rotated with respect to FIG. 9. FIG. 11 is a view explaining the relationship of intake volumes of the orbiting outer compression chamber and the orbiting inner compression chamber and the crankshaft rotational angle in the present embodiment.

When the orbiting scroll 6 starts orbiting, the contact point of the orbiting scroll 6 and the fixed scroll 5 moves toward the center portion. At this time, as shown in FIGS. 9 and 10, in the space enclosed by the wrap outer peripheral surface 661 of a wrap terminal end portion 6*n* of the orbiting scroll 6 and the wrap inner peripheral surface 561 of the fixed scroll 5, the orbiting outer compression chamber 8*a* is formed, and in the space enclosed by the wrap inner peripheral surface 662 of the orbiting scroll 6 and the wrap outer peripheral surface 562 of the fixed scroll 5, the orbiting inner compression chamber 8*b* is formed. The orbiting outer compression chamber 8*a* and the orbiting inner compression chamber 8*b* move while sequentially reducing in volume toward the center portion, as a result of which, the helium gas at a low pressure which is sucked from the intake port 15 is compressed and is discharged to the space 1*a* in the hermetically sealed container 1 from the discharge port 10.

Here, the intake volume of the orbiting outer compression chamber 8*a* and the intake volume of the orbiting inner compression chamber 8*b* are in such a relationship that they alternately increase and decrease, that is, the intake volumes change so that when one increases, the other decreases.

The set volume ratio Vrs which is set in the orbiting outer compression chamber 8*a* is defined by the following expression (2). Here, the set volume ratio Vrs means the value obtained by dividing the stroke volume Vths which is the maximum intake volume of the orbiting outer compression chamber 8*a* by the volume Vd1 of the innermost chamber at the side of the orbiting outer compression chamber 8*a* just before the discharge stroke of the compression chamber 8.

[Expression 2]

$$Vrs = \frac{2\lambda ls - 4\pi + \alpha}{2\lambda ss + 2\pi + \alpha} \tag{2}$$

Here,

λls: Wrap winding end angle at the point 55 (involute development angle)

λss: wrap winding start angle at point 51 (involute development angle)

π: circle ratio

α: ratio (=ϵth/α) of orbiting radius ϵth and base circle radius a of the scroll wrap Meanwhile, the set volume ratio Vrk which is set in the orbiting inner compression chamber 8*b* is defined by the following expression (3). Here, the set volume ratio Vrk means the value obtained by dividing the stroke volume Vthk which is the maximum intake volume of the orbiting inner compression chamber 8*b* by the volume Vd1 of the innermost chamber at the side of the orbiting inner compression chamber 8*b* just before the discharge stroke of the compression chamber.

[Expression 3]

$$Vrk = \frac{2\lambda lk - 4\pi + \alpha}{2\lambda sk + 2\pi + \alpha} \tag{3}$$

Here,

λlk: wrap winding end angle at the point 54 (involute development angle)

λsk: wrap winding start angle at the point 53 (involute development angle)

The stroke volumes of the orbiting outer compression chamber 8*a* and the orbiting inner compression chamber 8*b* are in the relationship of Vths>Vthk from the geometric shapes. 6*m* of the orbiting scroll 6 is the groove shape of the recessed portion which has a size equivalent to the discharge hole 10 at the side of the fixed scroll 5.

Further, the set volume ratio Vrs of the orbiting outer compression chamber 8*a* and the set volume ratio Vrk of the orbiting inner compression chamber 8*b* are set to be substantially equivalent to each other. More practically, the set volume ratios which are suitable to a relatively low pressure ratio operation condition of Vrk=Vrs=2.0 to 2.4 are adopted. This is due to the operation condition peculiar to helium, that is, many helium compressors have the operation conditions in a low pressure ratio range, for example, the operation conditions of about the pressure ratio=1.6 to 2.8, for example.

Here, the winding angle of the wrap will be described. The winding angle refers to a winding end angle or a winding start angle.

In the orbiting scroll 6, the wrap winding end angles at the point 64 and the point 65 are both 19.24 rad, and the wrap winding start angles at the point 61 and the point 63 are 1.5 rad and about 4.6 rad. In contrast, in the fixed scroll 5, the wrap winding end angles at the point 53 and the point 54 are 16.1 rad and 19.24 rad respectively, so that the inner curve 561 of the wrap of the fixed scroll 5 is constituted to be extended by a predetermined angle of πrad as the winding angle with respect to the outer curve 562. The points 51 and 53 of the fixed scroll 5 are located in the same positions relatively to the points 63 and 64 of the orbiting scroll 6. Further, the set volume ratio Vrs of the orbiting outer compression chamber

8*a* and the set volume ratio Vrk of the orbiting inner compression chamber 8*b* are set to be substantially equal. In concrete, the volume ratios are set to be the set volume ratios suitable to relatively low pressure ratio operation conditions of Vrk=Vrs=2.3 to 2.6. This is due to the operation condition peculiar to helium, that is, the operation conditions of many helium compressors are the operation conditions in the low pressure ratio region (pressure ratio=about 2 to 2.8).

A position 6*k* at the wrap terminal end portion of FIG. 6 is at wrap winding end angles $\lambda_{1s}$ and $\lambda_{1k}$, and the position of a wrap start end portion 6*n* is at the above described wrap winding start angles λss and λsk. The tooth groove dimension (Dt dimension of FIG. 6) is given by the following expression (4) similarly to the fixed scroll wrap.

$$Dt=2\times\epsilon th+t \qquad \text{[Expression 4]}$$

The above described Dt dimension and Rs2 dimension or Rk2 dimension are substantially in the relation of Dt=Rs2×2.0 or Dt=Rk2×2.0.

Here, the state in which the intake volume of the orbiting outer compression chamber 8*a* becomes the maximum, and the state in which the intake volume of the orbiting inner compression chamber 8*b* becomes the maximum will be described by using FIGS. 9 and 10.

As shown in FIG. 9, when the intake volume of the orbiting outer compression chamber 8*a* becomes the maximum, the wrap outer peripheral surface 661 at the terminal end portion of the orbiting scroll 6 is in contact with the wrap inner peripheral surface 562 of the fixed scroll 5, and the point 65 and the point 54 are in contact with each other at this time. FIG. 9 shows the state at the time of completion of intake which is the timing of forming the maximum hermetically sealed volume of the orbiting outer compression chamber 8*a*. In the state in which the point 65 and the point 54 are superimposed on each other, the opening of the oil injecting port 22*a* is in the positional relation in the state closed by the tooth tip portion of the orbiting scroll wrap.

In contrast with this, as shown in FIG. 10, when the intake volume of the orbiting inner compression chamber 8*b* becomes the maximum, the wrap inner peripheral surface 662 at the terminal end portion of the orbiting scroll 6 is brought into contact with the wrap outer peripheral surface 561 of the fixed scroll 5, and the point 64 and the point 53 are in contact with each other at this time. FIG. 10 shows the state at the time of intake completion which is at the timing of forming the maximum hermetically sealed volume of the orbiting inner compression chamber 8*b*. In the state in which the point 64 is superimposed on the point 53, the opening of the oil injecting port 22*b* is in the positional relationship in the state in which the opening is closed by the tooth tip portion of the orbiting scroll wrap. Thereafter, when the crankshaft turns 180 degrees, the state shifts to that of FIG. 9.

By adopting such a positional relationship, both the gas cooling function and the seal function in the operation chamber to the orbiting outer compression chamber 8*a* and the orbiting inner compression chamber 8*b* can be performed substantially equally. Further, the compression efficiency (illustrated efficiency) of both the compression chambers can be enhanced equally.

In the present embodiment, the shape of the scroll wrap is formed so that in the fixed scroll 5, the winding angles (winding end angles) at the points 53 and 54 to be the contact point positions with the terminal end portion of the orbiting scroll 6 are set such that the winding angle at the point 54 is extended by πrad with respect to the winding angle of the point 53, and in the orbiting scroll 6, the winding angles (winding end angles) at the points 64 and 65 are caused to correspond to the winding angle at the point 54 of the fixed scroll 5.

FIG. 11 shows the relationship of the intake volumes of the orbiting outer compression chamber 8*a* and the orbiting inner compression chamber 8*b*, and the rotational angle of the crankshaft in the present embodiment. According to the shape of the scroll wrap of the present embodiment, timing of the intake completion at which the intake volume of the orbiting outer compression chamber 8*a* becomes the maximum is a point B, and timing of the intake completion at which the intake volume of the orbiting inner compression chamber 8*b* becomes the maximum is a point A. Therefore, the timings at which both the compression chambers 8 have the maximum volumes generate a rotational phase difference of 180 degrees, and the number of intake completion timings is two during one rotation of the crankshaft 14.

Figure 20:
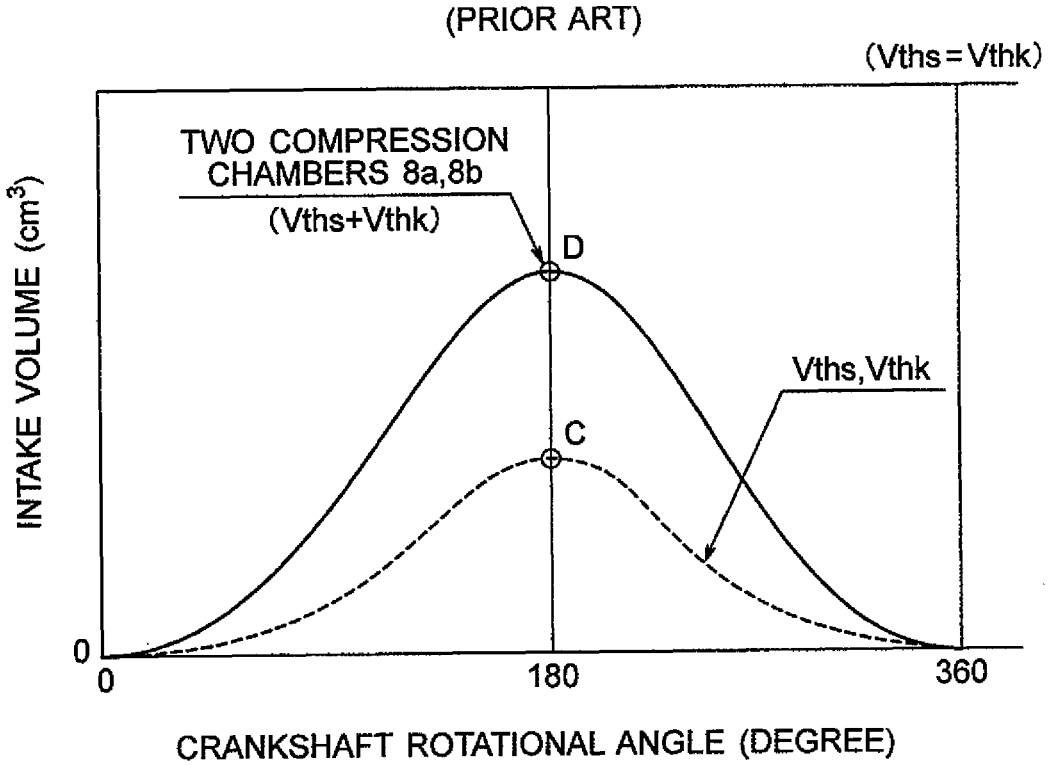
FIG. 20 is a diagram explaining the relationship of intake volumes of an orbiting outer compression chamber and an orbiting inner compression chamber, and a crankshaft rotational angle in a conventional art.

In contrast with this, according to the shape of the conventional scroll wrap, for example, in the fixed scroll 5, the winding angles at the points 53 and 54 which are the contact positions with the terminal end portion of the orbiting scroll 6 correspond to each other, and therefore, as shown in FIG. 20, the number of timings of intake completion is one during one rotation of the crankshaft 14. More specifically, each of the intake volumes of the orbiting outer compression chamber 8*a* and the orbiting inner compression chamber 8*b* becomes the maximum at the same time at the point C, and both the intake volumes increase to the point D at which the intake volumes become about twice as large as those at the point C when the intake volumes of both the compression chambers 8 are totalized.

According to the present embodiment, the number of timings of intake completion can be doubled to twice from one time of the conventional compressor, and therefore, the flow of helium gas and oil at the time of an intake stroke can be made continuous flow, the impact phenomenon which occurs as the gas pressure between the intake pipings 120 and 340 is shut off at the instant of intake completion of the compressor can be relieved, and in addition, the pressure pulsation which occurs at the side of the refrigerator 110 can be absorbed. Thereby, occurrence of abnormal vibration of the Oldham mechanism portion and the like, reduction in useful life of the compressor can be prevented, and reliability can be enhanced.

In addition, according to the present embodiment, the surge tank which is conventionally disposed in the compressor unit can be eliminated. Therefore, the refrigerator 110 and the compressor 100 can be directly connected by pipings, and the effect peculiar to the helium compressor unit 240 of being capable of simplifying the unit piping of the compressor can be obtained. Further, reduction in the weight and cost of the helium compressor unit 240 as a whole can be realized.

In the present embodiment, due to the constitution in which the orbiting outer compression chamber 8*a* and the orbiting inner compression chamber 8*b* are shifted by πrad in terms of pressure, the middle pressure hole 6*d* and the oil discharge hole 6*f* are not disposed in the positions along the inner curve 662 of the orbiting scroll 6. This is because if they are disposed in the positions along the inner curve 662, the middle pressure hole 6*d* and the oil discharge hole 6*f* have to be disposed in the orbiting bearing direction so as to be located in the position further inward by πrad, and the drawback in machining, that is, hole machining becoming difficult occurs. The positions of the middle pressure hole 6*d* and the oil discharge hole 6*f* are practically about the positions of the following expressions (5) to (7).

[Expression 5]

$$\lambda d=(\lambda ls-2\pi)+\Delta\lambda d \qquad (5)$$

$$\Delta\lambda d=1.0-1.5 \quad (6)$$

$$\lambda f=\lambda b+0.5(\text{rad}) \quad (7)$$

Here,

λd=wrap winding angle showing the position of the middle pressure hole 6*d*

λf=wrap winding angle showing the position of the oil discharge hole 6*f*

λls: wrap winding end angle (rad) (involute development angle at the point 55)

The opening of the middle pressure hole 6*d*, which opens to the orbiting outer compression chamber 8*a* has a communicating angle of Δλd (1.0 to 1.5 rad) for intermittently communicating with the intake chamber 5*f* in the wrap outer peripheral portion of the orbiting scroll 6, and further, the oil discharge hole 6*f* intermittently communicates with the intake chamber 5*f* by the amount of 0.5 rad. Thereby, the oil discharge mechanism constituted of the lateral hole 6*h* and the oil discharge hole 6*f* lets the oil accumulating in the outer peripheral portion of the orbiting scroll 6 to escape to the side of the compression chamber 8 by the pressure difference, and the oil agitating power in the outer peripheral portion can be reduced. Therefore, power consumption of the motor of the compressor can be reduced.

More specifically, a helium gas does not dissolve into oil, and therefore, in a hermetically sealed scroll compressor for helium, for example, the viscosity of oil is about 20 cSt, whereas in the scroll compressor for refrigeration/air conditioning which does not use helium gas, the operating gas dissolves into oil and is diluted, and therefore, the oil viscosity reduces to about 10 cSt, for example. The magnitude of the oil agitating power becomes large proportionally to the oil viscosity in the outer peripheral portion of the orbiting scroll 6, and therefore, in the case without having the oil discharge mechanism of the present embodiment, the oil agitating power of the compressor 100 generates agitating power loss of about twice as large as that of the present embodiment. Accordingly, in order to reduce such a large oil agitating power in a hermetically sealed scroll compressor for helium, the oil discharge mechanism of the present embodiment is needed.

When the oil discharge hole 6*f* intermittently communicates with the intake chamber 5*f* like this, the oil accumulated in the outer peripheral portion of the orbiting scroll 6 is easily caused to escape to the compression chamber 8 side by the pressure difference between the pressure (middle pressure) of the outer peripheral portion of the orbiting scroll 6 and the pressure of the intake chamber 5*f* since the intake chamber 5*f* has the lowest intake pressure, and oil agitating power can be easily reduced.

Further, in the present embodiment, as shown in FIG. 9, the wrap tooth tip portion of the orbiting scroll 6 is set to be located in substantially the center of the opening of the oil injecting port 22 when the outer peripheral surface of the wrap terminal end portion of the orbiting scroll 6 is in contact with the inner peripheral surface of the fixed scroll, and the point 65 and the point 54 are superimposed on each other. Further, the wrap tooth tip portion of the orbiting scroll 6 is set to be located in substantially the center of the opening of the oil injecting port 22 as in FIG. 9 when the crankshaft rotates 180 degrees, the inner peripheral surface of the wrap terminal end portion of the orbiting scroll 6 is in contact with the outer peripheral surface of the fixed scroll, and the point 64 and the point 53 are superimposed on each other as shown in FIG. 10.

By adopting such a positional relationship, both the gas cooling function and the seal function are performed substantially equally for the orbiting outer compression chamber 8*a* and the orbiting inner compression chamber 8*b*, and the compression efficiency of both the compression chambers 8 can be enhanced equally.

Further, the opening of the oil injecting port 22 intermittently communicates with the intake chamber 5*f* of the wrap outer peripheral side of the orbiting scroll 6 by the time just before intake completion, and the intake stroke takes place twice with change in phase by 180 degrees during one rotation of the crankshaft 14. More specifically, in the state of FIG. 9, the middle pressure hole 6*d* and the oil discharge hole 6*f* do not communicate with the oil injecting port 22 located at the downstream side through the compression chambers 8, but in the state of FIG. 10, they communicate with each other through the orbiting outer compression chamber 8*a*. The oil injecting port 22 is located at the position where the oil injecting port 22 intermittently communicates with the middle pressure hole 6*d* and the oil discharge hole 6*f*. Thereby, the function of preventing oil compression in the initial time of actuation of the oil accumulated in the compression chambers 8 can be given. Further, accumulated oil can be effectively discharged in the intake chamber 5*f*, and therefore, there is provided the effect peculiar to the hermetically sealed scroll compressor for helium that the action of reducing oil agitating loss in the intake chamber 5*f* can be obtained.

Figure 12:
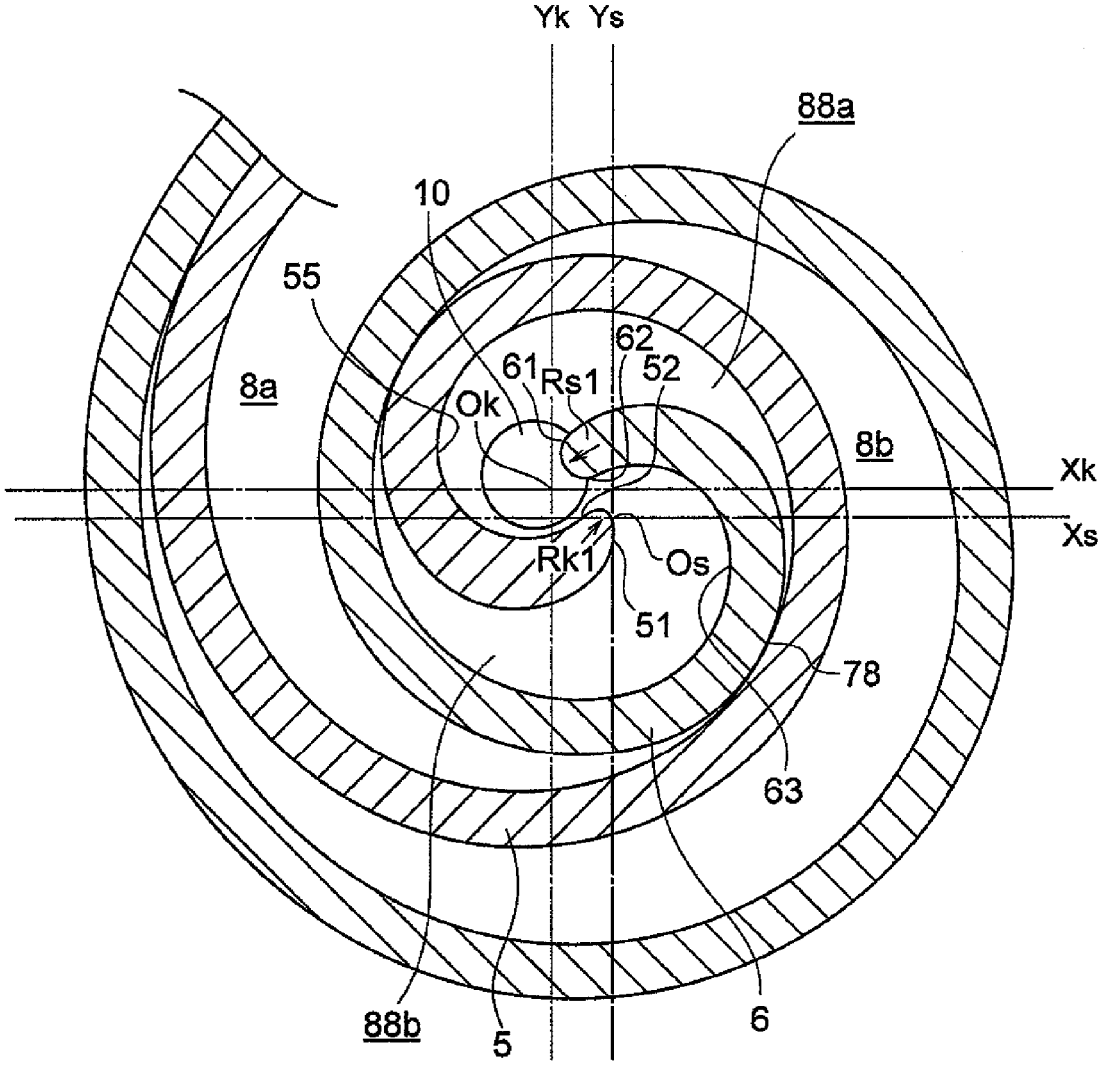
FIG. 12 is an enlarged view of a peripheral portion of a discharge hole in FIG. 9.
Figure 13:
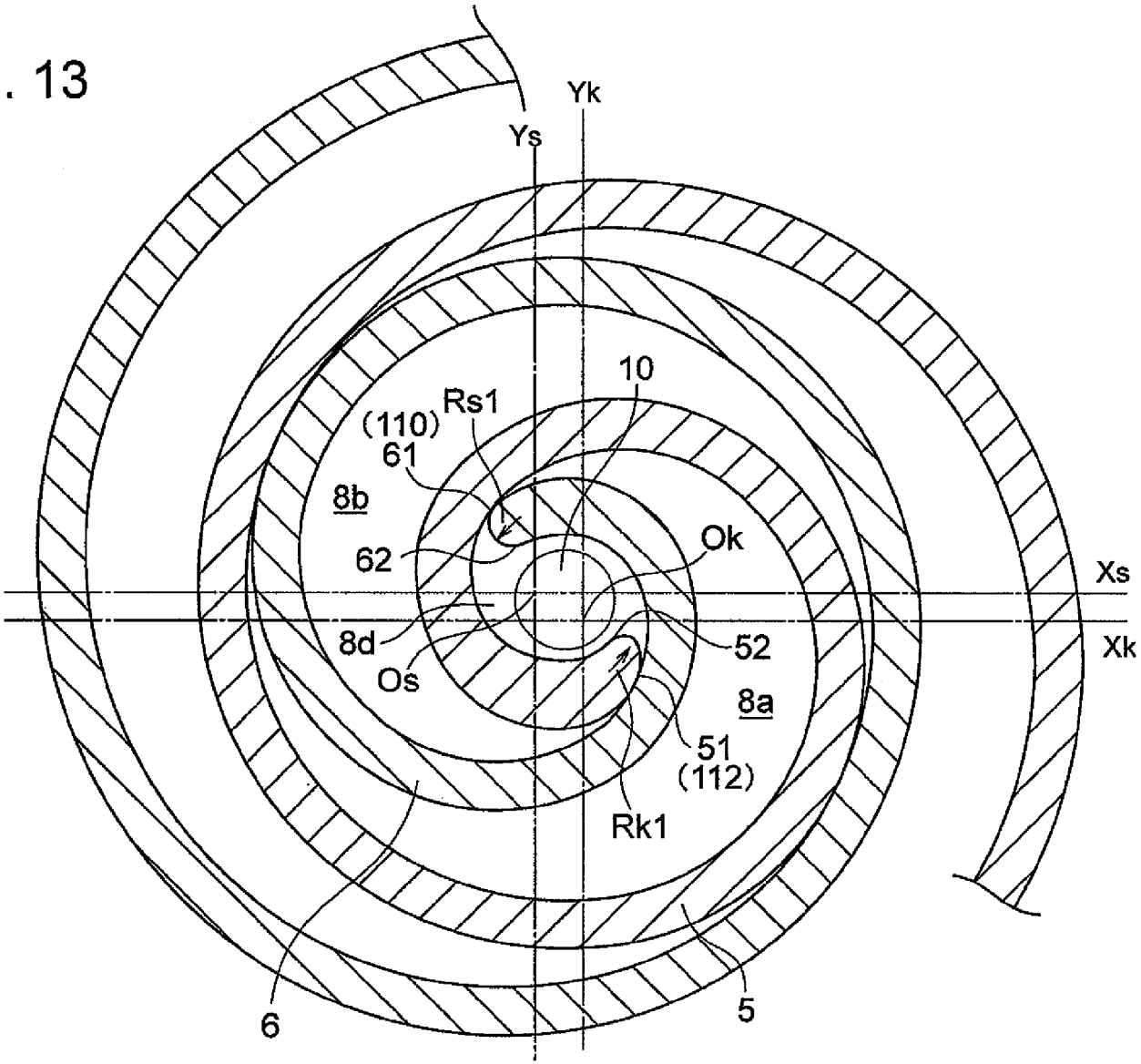
FIG. 13 is an enlarged view of the peripheral portion of the discharge hole in the state in which the compression stroke further progresses with respect to FIG. 12.
Figure 14:
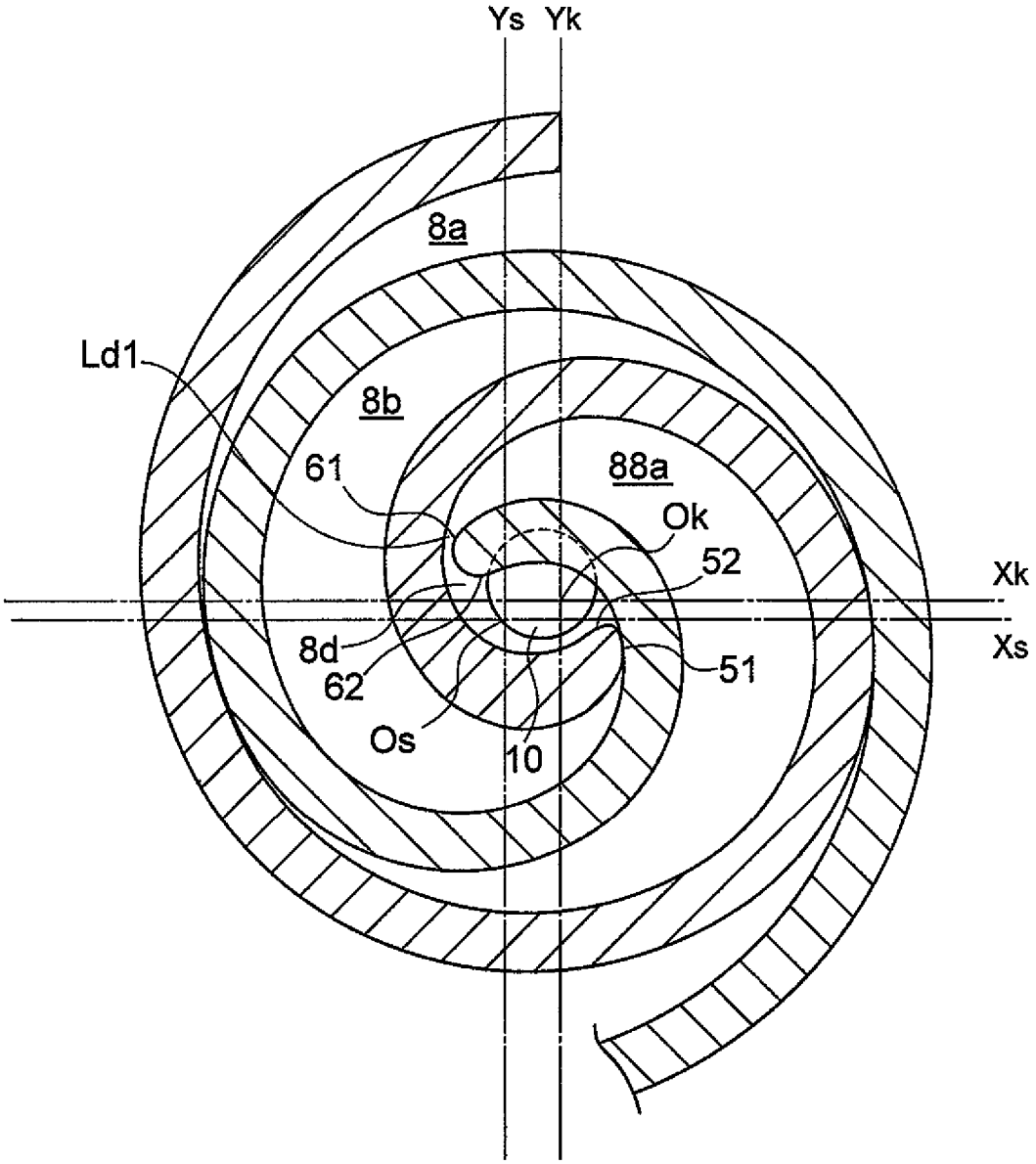
FIG. 14 is an enlarged view of the peripheral portion of the discharge hole in the state in which the compression stroke further progresses with respect to FIG. 13.
Figure 15:
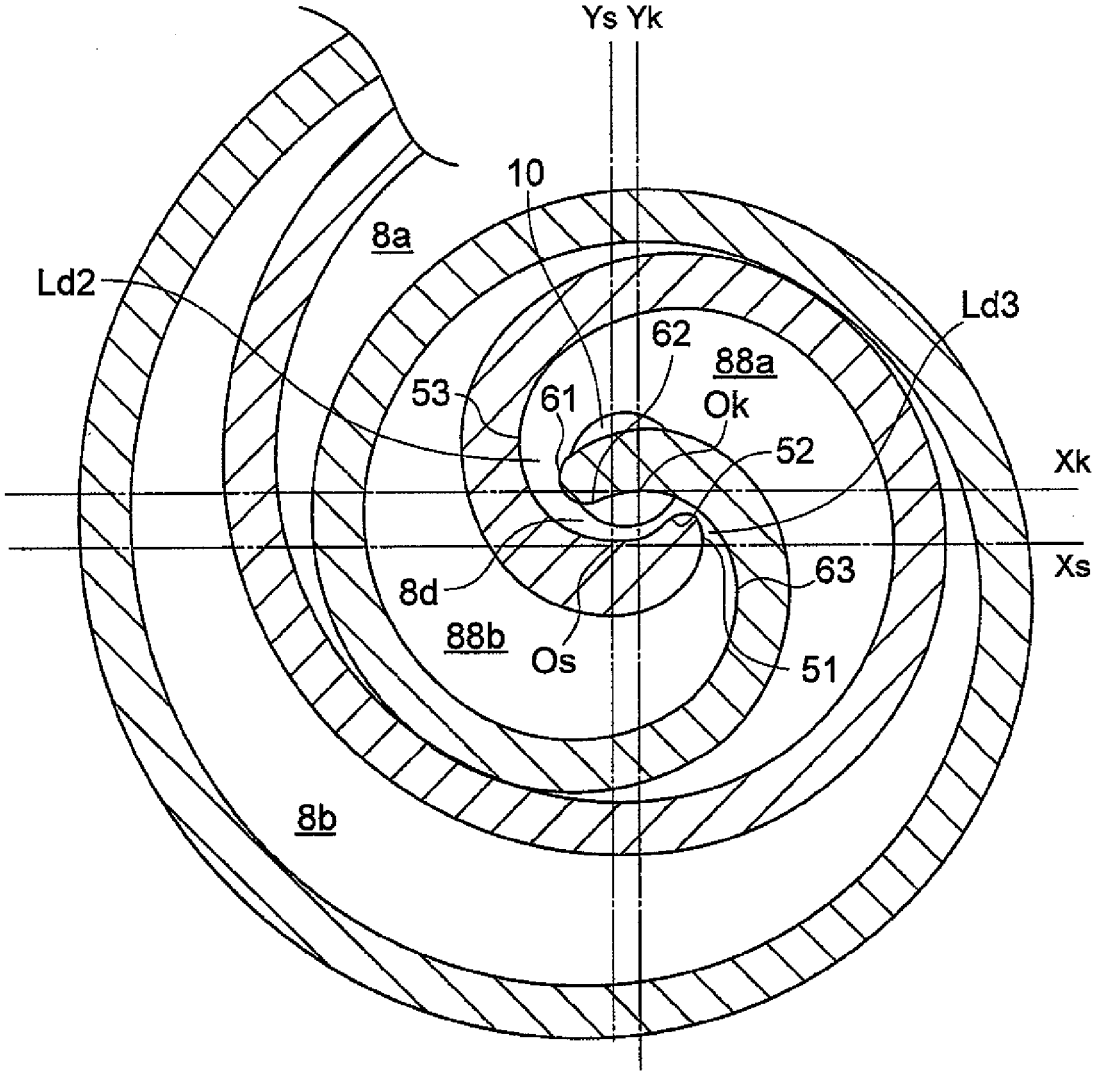
FIG. 15 is an enlarged view of the peripheral portion of the discharge hole in the state in which the compression stroke and discharge further progress with respect to FIG. 14.
Figure 16:
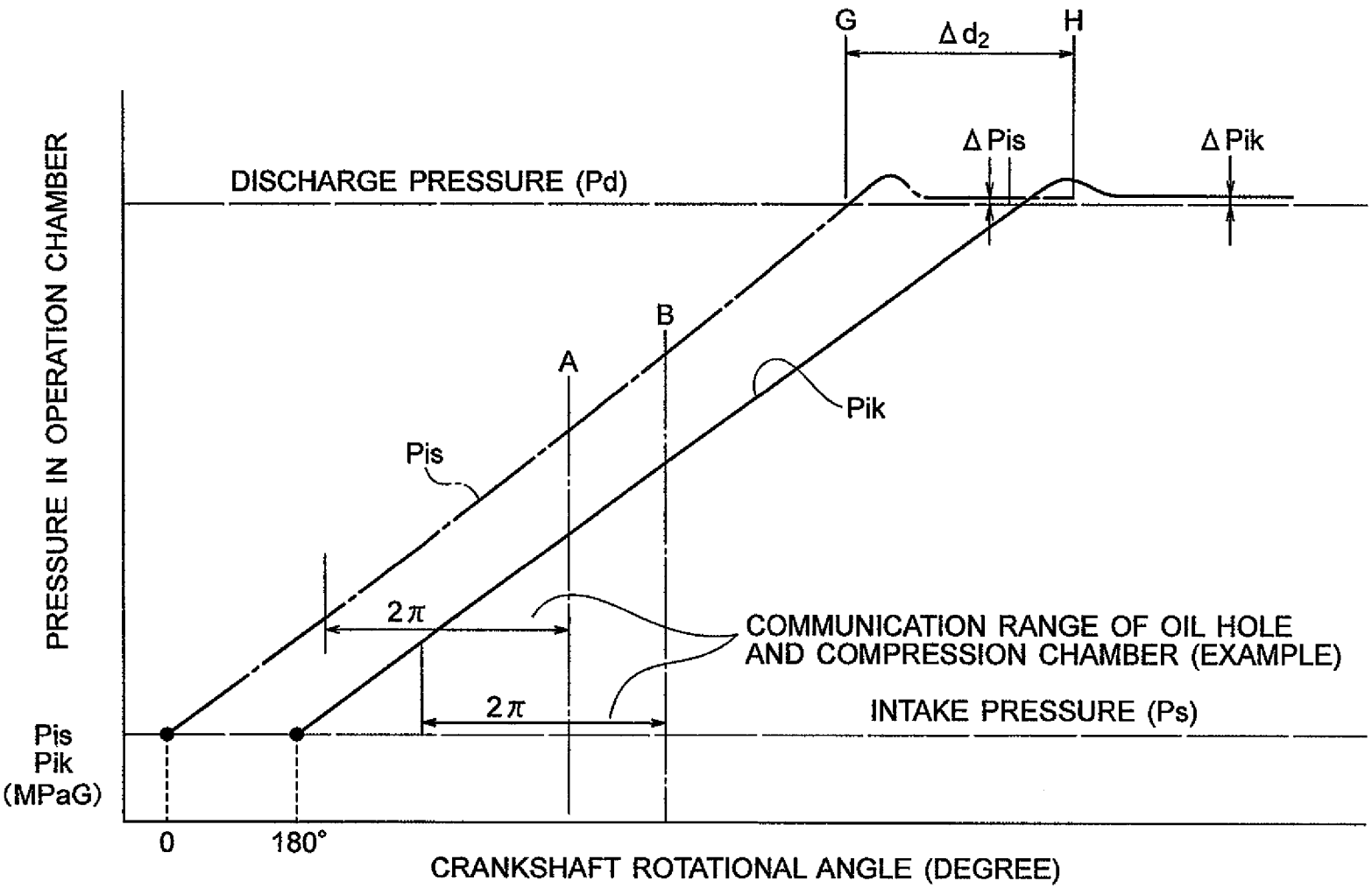
FIG. 16 is a diagram explaining the relationship of the pressures in operation chambers of the orbiting outer compression chamber and the orbiting inner compression chamber, and the crankshaft rotational angle in the first embodiment.

Next, the arc radius of the tip end portion to be the wrap winding start portion will be described with reference to FIGS. 12 to 16. FIG. 12 is an enlarged view of a peripheral portion of a discharge hole in FIG. 9. FIG. 13 is an enlarged view of the peripheral portion of the discharge hole in the state in which the compression stroke progresses with respect to FIG. 12. FIG. 14 is an enlarged view of the peripheral portion of the discharge hole in the state in which the compression stroke further progresses with respect to FIG. 13. FIG. 15 is an enlarged view of the peripheral portion of the discharge hole in the state in which the compression stroke and discharge further progress with respect to FIG. 14. FIG. 16 is a diagram explaining the relationship of the pressures in the operation chambers of the orbiting outer compression chamber and the orbiting inner compression chambers, and the crankshaft rotational angle in the present embodiment.

The arc radius Rs1 of the tip end portion to be the winding start portion of the orbiting scroll 6 is set to be larger than the arc radius Rk1 of the tip end portion to be the winding start portion of the fixed scroll 5. In concrete, Rk1 is set in the range of Rk1=1.2 to 1.5 mm, whereas Rs1 is set in the range of Rs1=1.8 to 2.2 mm, and thereby, the relationship of Rs1>Rk1 is established. Further, the arc radius Rs1 and the arc radius Rk1 are set in the range of the ratio of about Rs1/Rk1=1.4 to 1.6. Thereby, the discharge flow timings/phases of the operating gas and oil in the orbiting outer compression chamber 8*a* and the orbiting inner compression chamber 8*b* can be shifted.

More specifically, in the orbiting outer compression chamber 8*a* and the orbiting inner compression chamber 8*b*, the compression stroke and the discharge stroke are performed as shown in FIGS. 12 to 15. FIG. 12 shows the state in which a orbiting outer compression chamber 88*a* and an orbiting inner compression chamber 88*b* in the discharge stroke in which they communicate with the discharge hole 10, and the orbiting outer compression chamber 8*a* and the orbiting inner compression chamber 8*b* in the compression stroke by contact points 78 and 79 are formed. When the compression stroke progresses with respect to FIG. 12, the point 61 of the orbiting scroll 6 forms a contact point 110 of the orbiting outer compression chamber 8*a*, and the point 51 of the fired scroll 115 forms a contact point 112 of the orbiting inner compression chamber 8*b*, as shown in FIG. 13. When the compression stroke further progresses with respect to FIG. 13, the orbiting outer compression chamber 8*a* connects to the innermost chamber 8*d* side via a gap Ld1 and becomes the orbiting outer compression chamber 88*a* in the discharge stroke as shown in FIG. 14, but the point 51 of the fixed scroll forms a contact point 113 of the orbiting inner compression chamber 8*b* and does not connect to the innermost chamber 8*d* side. This is due to the difference between the arc radiuses Rs1 and Rk1 of the tip end portions of both the scrolls 5 and 6. When the discharge stroke and the compression stroke further progress with respect to FIG. 14, the orbiting outer compression chamber 88*a* and the orbiting inner compression chamber 88*b* completely connect to the innermost chamber 8*d* side via gaps Ld2 and Ld3, and both the compression chambers 88*a* and 88*b* are brought into the discharge stroke at the same time.

Figure 21:
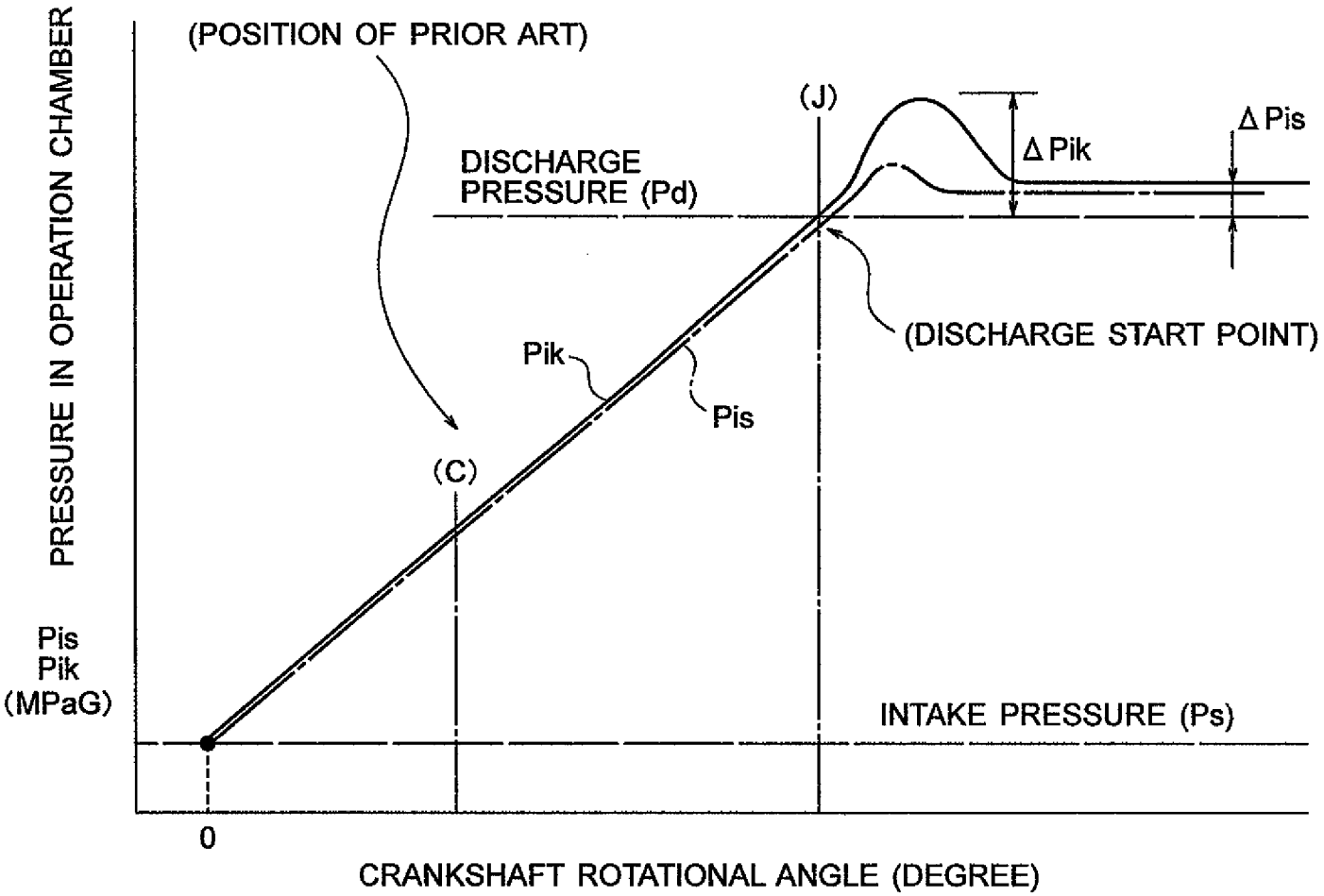
FIG. 21 is a diagram explaining the relationship of the pressures in operation chambers of the orbiting outer compression chamber and the orbiting inner compression chamber, and the crankshaft rotational angle in the conventional art.

In the present embodiment, an internal pressure Pis of the orbiting outer compression chamber 8*a* and an internal pressure Pik of the orbiting inner compression chamber 8*b* change as shown in FIG. 16 with respect to the rotational angle of the crankshaft 14. As is obvious from FIG. 16, in the change of the pressure Pis of the orbiting outer compression chamber 8*a*, the timing of discharge start is at a point G, whereas the timing of discharge start of the orbiting inner compression chamber 8*b* is at a point H, and a phase difference Δd1 of it occurs. The value of Δd1 is preferably ⅓ πrad to ½ πrad practically. Meanwhile, in the prior art, as shown in FIG. 21, the timings of start of discharge of the orbiting outer compression chamber and the orbiting inner compression chamber are the same time at a point J. Therefore, in the present embodiment, the number of timings of start of discharge is doubled to twice from one time with respect to the prior art. Thereby, the pressure losses ΔPik and ΔPis which occur in the prior art can be significantly reduced to the pressure losses ΔPik and ΔPis which are shown in FIG. 16.

In this manner, the helium gas which flows out of the discharge port 10 and a large amount of oil of bearing lubricating oil and an injection oil flow out at the two timings in one rotation of the crankshaft 14, and a significant effect of reducing the pressure loss accompanying flow at the time of discharge process is obtained in combination of securing the discharge passage. The bearing lubricating oil and the total amount of injected oil especially pass through the discharge hole 10 as described above, and the effect of being capable of reducing the discharge pressure loss to about ¼ with respect to the conventional compressor, which is peculiar to a helium compressor, can be obtained. Further, there are provided the effects of being capable of obtaining a significant reduction effect of discharge pressure loss, and the effects of reducing compressor input and enhancement of performance as well as the effect of reducing discharge pressure pulsation width, which are peculiar to a helium compressor.

In the change of the pressure Pis of the orbiting outer compression chamber 8*a*, the timing of oil injection to the orbiting outer compression chamber 8*a* from the oil injecting port 22*a* is at a point A, and the injection range is 2π. Meanwhile, in the change of the pressure Pik of the orbiting inner compression chamber 8*b*, the timing of oil injection to the orbiting inner compression chamber 8*b* from the oil injecting port 22*b* is at a point B, and the injection range is similarly 2π. In this manner, the timings of oil injection differ.

Second Embodiment

Figure 17:
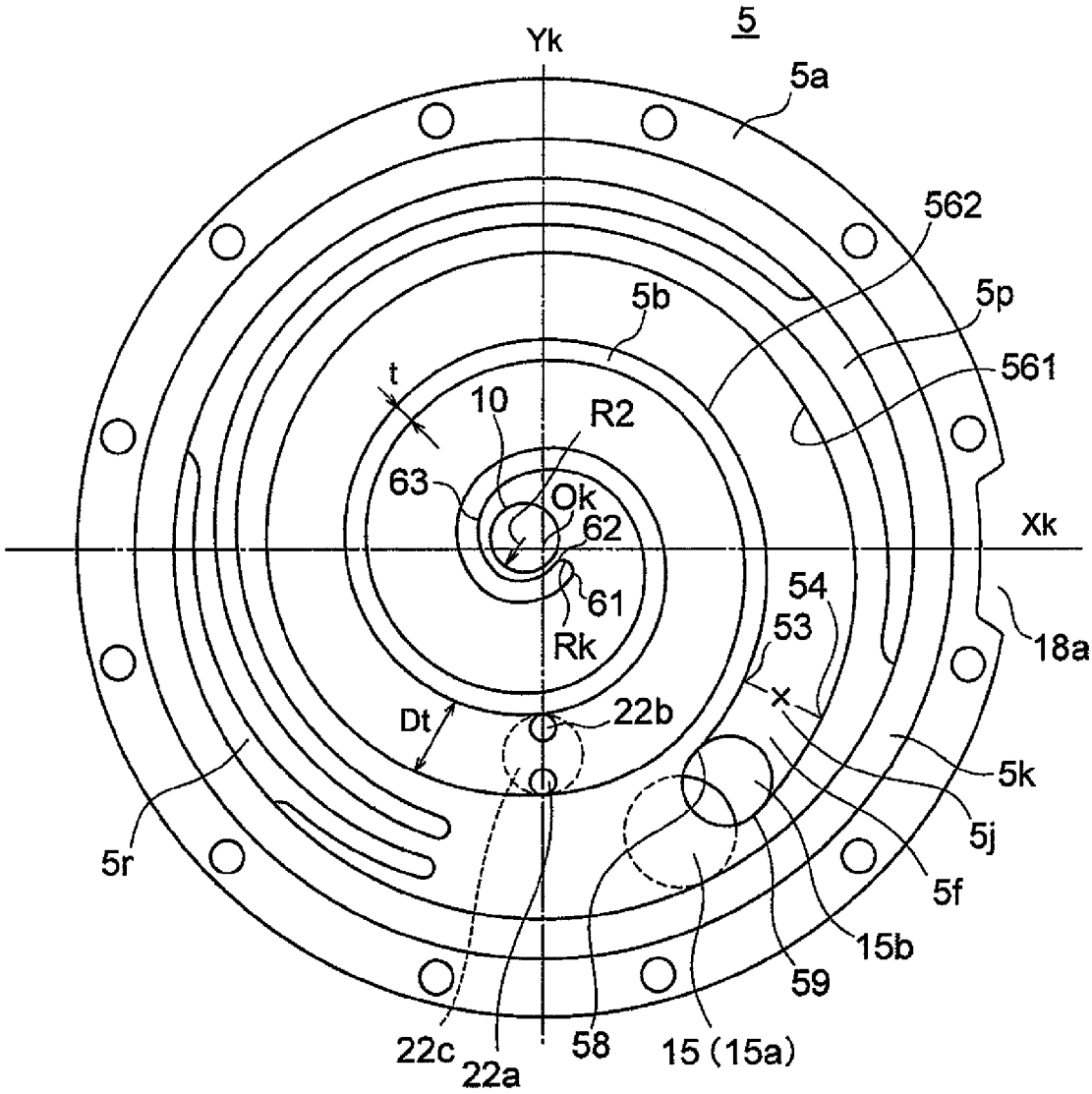
FIG. 17 is a plane view of a fixed scroll of a hermetically sealed scroll compressor for helium of a second embodiment of the present invention.

Next, a second embodiment of the present invention will be described by using FIG. 17. FIG. 17 is a plane view of a fixed scroll of a hermetically sealed scroll compressor of the second embodiment of the present invention. The second embodiment differs from the first embodiment in the point which will be described as follows, and the other points are basically the same as in the first embodiment. Therefore, the redundant description will be omitted.

In the second embodiment, the positions of the oil injecting ports 22*a* and 22*b* are set near to the inlet pressure side from the positions of the oil injecting ports 22*a* and 22*b* of the first embodiment. In concrete, the opening positions of the oil injecting ports 22*a* and 22*b* are sifted to the positions near to the inlet chamber 5*f* side by about π/6 to π/4 rad with respect to first embodiment. The amount of substantially the wrap tooth thickness t is taken into consideration in the amount of the shifted angle. By shifting the open position of the oil injecting port 22 to the low pressure side, the supply oil pressure difference increases, and even under the low pressure ratio operation condition, the cooling oil amount flowing in from the oil injection pipe 31 can be increased and secured, which is the structure preferable in performance.

Third Embodiment

Figure 18:
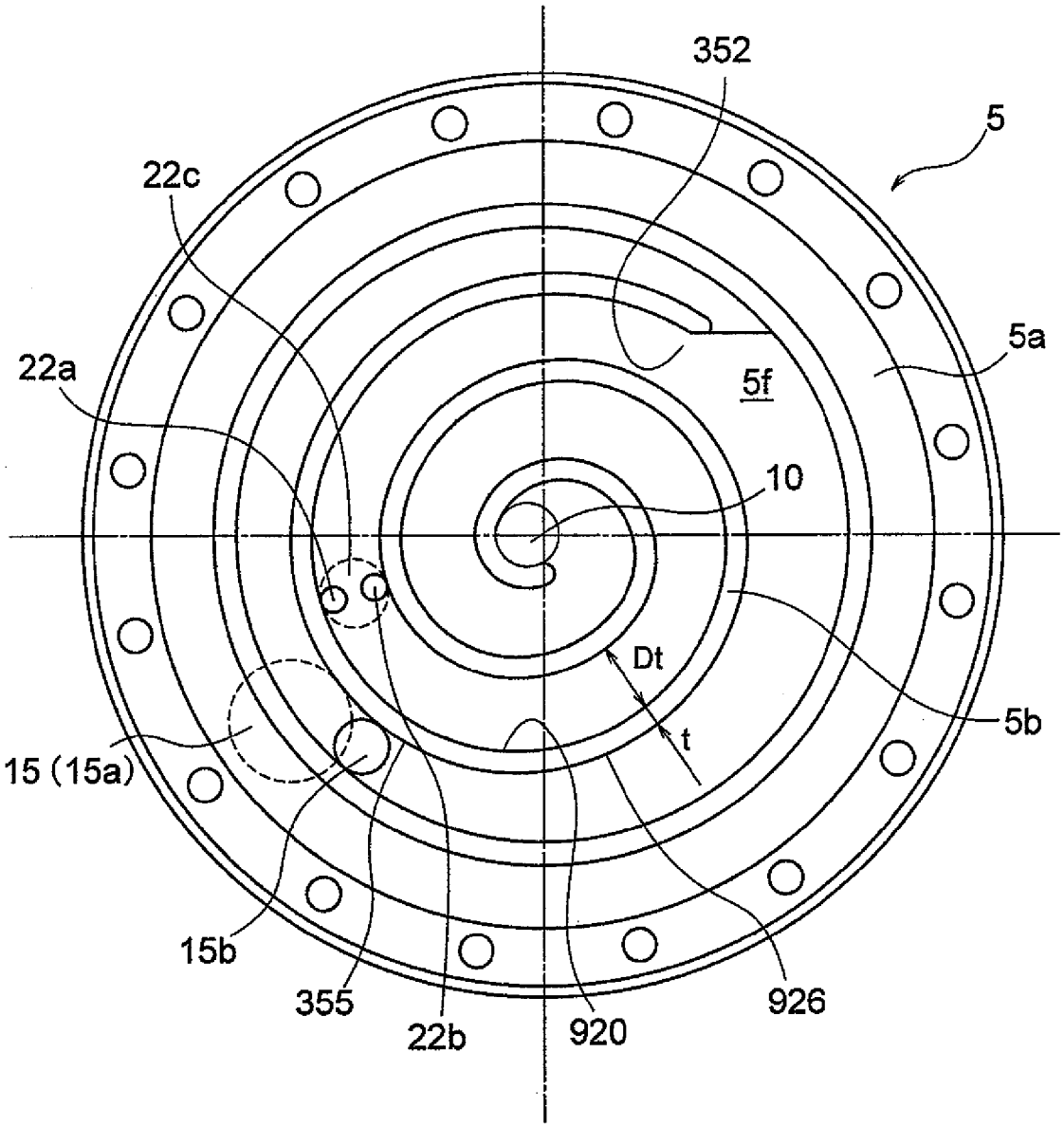
FIG. 18 is a plane view of a fixed scroll of a hermetically sealed scroll compressor for helium of a third embodiment of the present invention.
Figure 19:
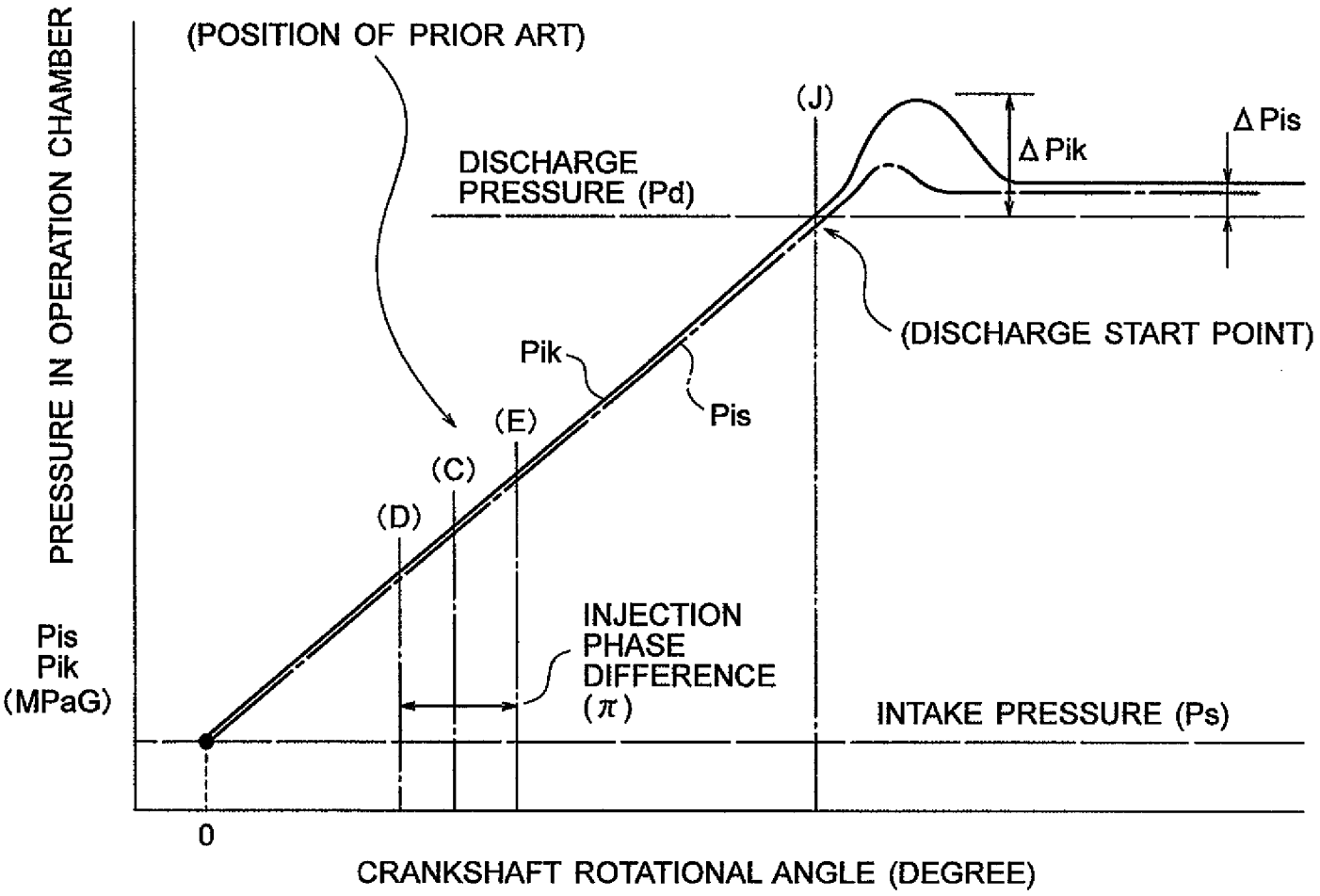
FIG. 19 is a diagram explaining the relationship of the pressures in operation chambers of an orbiting outer compression chamber and a orbiting inner compression chamber, and a crankshaft angle in the third embodiment.

Next, a third embodiment of the present invention will be described by using FIGS. 18 and 19. FIG. 18 is a plane view of a fixed scroll of a hermetically sealed scroll compressor of the third embodiment of the present invention. FIG. 19 is a diagram explaining the relationship of the pressures inside the operation chambers of the orbiting outer compression chamber and the orbiting inner compression chamber, and the crankshaft rotational angle in the hermetically sealed scroll compressor of the third embodiment. The third embodiment differs from the first embodiment in the point which will be described as follows, and is basically the same as the first embodiment in the other points. Therefore, the redundant description will be omitted.

In the third embodiment, in the wrap shape without extending the terminal end portion of the fixed scroll inner curve, the injection mechanism portion of the first embodiment is applied. More specifically, the oil injecting port 22*a* to the orbiting outer compression chamber 8*a* formed by the orbiting scroll outer curve and the fixed scroll inner curve is provided in the vicinity of a fixed scroll inner curve 920, whereas the oil injecting port 22*b* to the orbiting inner compression chamber formed by the orbiting scroll inner curve and a fixed scroll outer curve 926 is provided in the vicinity of the fixed scroll outer curve 926, and the two oil injecting ports 22*a* and 22*b* are in the positional relationship in which the two oil injecting ports are opposed to each other.

According to the third embodiment, the tow oil injecting port positions are set at different positions as the scroll wrap winding angles, and by the two oil injecting ports 22*a* and 22*b*, the timings of injecting oil to the orbiting outer compression chambers 8*a* and 8*b* sides can be shifted to the positions of a point D and a point E as shown in FIG. 19. The phase difference of the injection timings of the respective injecting ports 22*a* and 22*b* is πrad as shown in FIG. 19.

Other Embodiments

In the abovementioned embodiments, the compressor in which the operating gas is a helium gas, and oil is injected as a cooling medium is described, but the present invention is also applicable to a refrigeration/air conditioning scroll compressor using a fluorocarbon refrigerant as a cooling injection piping structure, and a structure for injecting a liquid refrigerant or wet refrigerant for cooling provided at a fixed scroll side. In concrete, when the operating gas is a fluorocarbon refrigerant gas, for example, R22, R410A or R404A refrigerant or the like, the present invention is characterized by being a compressor structure in which the cooling liquid is a liquid refrigerant for high-pressure fluorocarbon, or gas or a liquid refrigerant or a fluorocarbon refrigerant in a wet state is injected in the compression chambers.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A hermetically sealed scroll compressor for compressing a gas, comprising, a compression mechanism including a fixed scroll having a disk shaped mirror plate, a spiral wrap projecting from the disk shaped mirror plate, an intake port for taking the gas into the compression mechanism, and a discharge port for discharging the compressed gas from the compression mechanism, and an orbital scroll which is capable of orbiting with respect to the fixed scroll while being prevented from rotating on an axis of the orbital scroll and which has another disk shaped mirror plate and another spiral wrap projecting from the another disk shaped mirror plate to engage with the spiral wrap so that a first compression chamber is formed between a radially outer side surface of the another spiral wrap and a radially inner side surface of the spiral wrap, a second compression chamber is formed between a radially inner side surface of the another spiral wrap and a radially outer side surface of the spiral wrap, and each of the first and second compression chambers moves radially inward to decrease in its volume to compress therein the gas taken from the intake port to be discharged from the discharge port, an electric motor for driving the compression mechanism so that the orbital scroll orbits with respect to the fixed scroll, a hermetically sealed container containing therein the compression mechanism and the electric motor, and an injection mechanism including an injection port opening on the disk shaped mirror plate to supply a fluid into the gas in the first and second compression chambers, wherein the injection port has first and second injection port portions juxtaposed to each other so that the another spiral wrap is movable between the first and second injection port portions while the spiral wrap is prevented from extending between the first and second injection port portions, the first and second injection port portions communicate fluidly with a common fluidal path for supplying the fluid from the common fluidal path to each of the first and second injection port portions, one of the first and second injection port portions is arranged at a radially inner side with respect to the other one of the first and second injection port portions, and a fluidal flow resistance between the common fluidal path and the one of the first and second injection port portions is greater than another fluidal flow resistance between the common fluidal path and the other one of the first and second injection port portions.

2. The hermetically sealed scroll compressor according to claim 1, wherein one of the first and second injection port portions is arranged to be capable of opening to one of the first and second compression chambers, and to be prevented from opening to each of the first and second compression chambers.

3. The hermetically sealed scroll compressor according to claim 2, wherein each one of the first and second injection port portions is arranged to be capable of opening to respective one of the first and second compression chambers, and to be prevented from opening to each of the first and second compression chambers.

4. The hermetically sealed scroll compressor according to claim 1, wherein the first and second injection port portions are arranged to prevent during the whole of each orbital rotation of the orbital scroll one of the first and second compression chambers from simultaneously communicating fluidly with both of the first and second injection port portions.

5. The hermetically sealed scroll compressor according to claim 4, wherein the first and second injection port portions are arranged to prevent during the whole of each orbital rotation of the orbital scroll each one of the first and second compression chambers from simultaneously communicating fluidly with both of the first and second injection port portions.

6. The hermetically sealed scroll compressor according to claim 1, wherein one of the first and second injection port portions is arranged to be capable of opening to one of the first and second compression chambers, and to be prevented during the whole of each orbital rotation of the orbital scroll from opening to the other one of the first and second compression chambers.

7. The hermetically sealed scroll compressor according to claim 6, wherein each one of the first and second injection port portions is arranged to be capable of opening to respective one of the first and second compression chambers, and to be prevented during the whole of each orbital rotation of the orbital scroll from opening to the other one of the first and second compression chambers other than the respective one thereof.

8. The hermetically sealed scroll compressor according to claim 1, wherein one of the first and second injection port portions is arranged to allow the another spiral wrap to move in a direction from the other one of the first and second injection port portions toward the one of the first and second injection port portions until the one of the first and second injection port portions is covered by the another spiral wrap, and to prevent the another spiral wrap from passing over the one of the first and second injection port portions in the direction until the one of the first and second injection port portions is uncovered by the another spiral wrap.

9. The hermetically sealed scroll compressor according to claim 8, wherein each one of the first and second injection port portions is arranged to allow the another spiral wrap to move in a direction from the respective other one of the first and second injection port portions toward the each one of the first and second injection port portions until the each one of the first and second injection port portions is covered by the another spiral wrap, and to prevent the another spiral wrap from passing over the each one of the first and second injection port portions in the direction until the each one of the first and second injection port portions is uncovered by the another spiral wrap.

10. The hermetically sealed scroll compressor according to claim 1, wherein a minimum inner diameter of the one of the first and second injection port portions is less than another minimum inner diameter of the other one of the first and second injection port portions.

11. The hermetically sealed scroll compressor according to claim 1, wherein the radially outer side surface of the another spiral wrap at a radially outer end portion of spiral shape of the another spiral wrap contacts the radially inner side surface of the spiral wrap at a first contact point to make a volume of the first compression chamber maximum, the radially inner side surface of the another spiral wrap at the radially outer end portion of spiral shape of the another spiral wrap contacts the radially outer side surface of the spiral wrap at a second contact point to make a volume of the second compression chamber maximum, a winding angle of the spiral wrap at the first contact point is extended angularly by a predetermined angle with respect to a winding angle of the spiral wrap at the second contact point, and each of a winding angle of the another spiral wrap at the first contact point and a winding angle of the another spiral wrap at the second contact point is angularly identical to the winding angle of the spiral wrap at the first contact point.

12. The hermetically sealed scroll compressor according to claim 1, wherein an arc radius of a radially inner terminating end of the another spiral wrap is greater than an arc radius of a radially inner terminating end of the spiral wrap.

13. The hermetically sealed scroll compressor according to claim 1, wherein the gas includes helium, and the fluid includes oil.

14. The hermetically sealed scroll compressor according to claim 1, wherein the gas includes chlorofluorocarbon refrigerant, and the fluid includes at least one of a gaseous matter, a liquid matter and a refrigerant of wet state.

15. The hermetically sealed scroll compressor according to claim 11, wherein the winding angle of the spiral wrap at the first contact point is extended angularly by wad with respect to the winding angle of the spiral wrap at the second contact point.

16. The hermetically sealed scroll compressor according to claim 11, wherein a compression ratio of the first compression chamber and a compression ratio of the second compression chamber are substantially equal to each other.

17. The hermetically sealed scroll compressor according to claim 12, wherein in a case of that the arc radius of the radially inner terminating end of the spiral wrap is denoted by Rk1, and the arc radius of the radially inner terminating end of the another spiral wrap is denoted Rs1, Rs1/Rk1=1.4-1.6.

* * * * *